US005962208A

United States Patent [19]

Hasebe

[11] Patent Number: 5,962,208

[45] **Date of Patent: *Oct. 5, 1999**

[54] SILVER HALIDE COLOR PHOTOGRAPHIC MATERIAL CONTAINING A YELLOW COUPLER AND A MERCAPTO COMPOUND

[75] Inventor: Kazunori Hasebe, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,379

[22] Filed: May 28, 1997

Related U.S. Application Data

[63] Continuation of application No. 07/640,468, Jan. 11, 1991, abandoned.

[30] Foreign Application Priority Data

Jan. 12, 1990 [JP] Japan ..... 2-4905

[51] Int. Cl.[6] ..... G03C 1/08; G03C 7/26; G03C 7/32

[52] U.S. Cl. ..... 430/551; 430/556; 430/557; 430/567; 430/599; 430/607; 430/611; 430/613

[58] Field of Search ..... 430/567, 551, 430/605, 599, 607, 611, 613, 556, 557

[56] References Cited

U.S. PATENT DOCUMENTS

| | | | |
|---|---|---|---|
| 4,840,878 | 6/1989 | Hirose et al. | 430/505 |
| 5,035,988 | 7/1991 | Nakamura et al. | 430/551 |
| 5,070,003 | 12/1991 | Naruse et al. | 430/557 |
| 5,153,110 | 10/1992 | Kawai et al. | 430/567 |
| 5,399,475 | 3/1995 | Hasebe et al. | 430/567 |

FOREIGN PATENT DOCUMENTS

| | | | |
|---|---|---|---|
| 0273430 | 7/1988 | European Pat. Off. | 430/567 |

*Primary Examiner*—Geraldine Letscher
*Attorney, Agent, or Firm*—Sughrue, Mion, Zinn, Macpeak & Seas, PLLC

[57] ABSTRACT

A silver halide color photographic material comprises at least one silver halide emulsion layer on a reflex support silver halide grains containing at least 90 mol % silver chloride and having a silver bromide-rich region in the vicinity of at least one grain corner, but having an average silver bromide content of 15 mol % or less at the grain surface, (ii) at least one yellow coupler represented by the following general formula (I); and (iii) at least one compound represented by the following general formula (II):

(I)

wherein $R_1$ represents an aryl group or a tertiary alkyl group; $R_2$ represents a fluorine atom, an alkyl group, an aryl group, an alkoxy group, an aryloxy group, a dialkylamino group, an alkylthio group, or an arylthio group; $R_3$ represents a group which can replace a hydrogen atom of a benzene ring; X represents a hydrogen atom or a group capable of being removed by a coupling reaction with an oxidation product of an aromatic primary amine developing agent; and l represents an integer from 0 to 4, and when l is 2 or more, the $R_3$ groups may be the same or different, (II)

wherein Q represents a group of atoms necessary to complete a 5- or 6-membered hetero ring which may be fused together with a benzene ring; and M represents a hydrogen atom or a cation.

15 Claims, No Drawings

SILVER HALIDE COLOR PHOTOGRAPHIC MATERIAL CONTAINING A YELLOW COUPLER AND A MERCAPTO COMPOUND

This is a Continuation of application Ser. No. 07/640,468 filed Jan. 11, 1991 now abandoned.

FIELD OF THE INVENTION

This invention relates to a silver halide color photographic material, and particularly to a color photographic paper, having excellent color reproducibility, high sensitivity and excellent rapid processability.

BACKGROUND OF THE INVENTION

Color development has been simplified and quickened as color photographic materials have come into wider use. At the same time, the desire for high quality images has increased.

Under these circumstances, photosensitive materials for color prints have been studied more widely with regard to speeding up photographic processing and improving color reproducibility than was the case in the past.

As to speeding up photographic processing, it recently has been found that silver halides with high chloride contents are effective for this purpose, and such halides are coming into prevailing use.

As to improving color reproducibility, many attempts have been made to decrease unnecessary absorptions by sharpening the respective absorption spectra of developed cyan, magenta and yellow dyes, which make up the colors of color prints. For instance, it has been reported that the absorption spectra of dyes formed by a coupling reaction with an oxidized product of a color developing agent are markedly sharpened by substituting pyrazoloazole magenta couplers for 5-pyrazolone magenta couplers, whereby the colors in the magenta to red regions and those in the blue region are rendered very clear. Detailed descriptions of such results can be found in JP-A-59-17956 (the term "JP-A" as, used herein means an "unexamined published Japanese patent application"), JP-A-60-172982, JP-A-61-65245, JP-A-61-65246, JP-A-61-147254, JP-A-62-89961, JP-A-60-262159, JP-A-61-28948, JP-A-62-24254, JP-A-62-87962, JP-A-62-92944, JP-A-62-201438, JP-A-62-201439, JP-A-62-174760, JP-A-62-174761, and JP-A-62-109050.

Also, attempts have been made to improve yellow couplers by reducing unnecessary absorptions in the magenta region through proper choice of the kind and the position of substituent groups. As described in JP-A-63-123047 and JP-A-63-2415, for example, such attempts have succeeded in enhancing color reproducibility.

However, yellow couplers whose absorption bands have been shifted to shorter wavelengths by proper choice and positioning of substituent groups as described above must be used in relatively high concentrations compared to conventional yellow couplers, because the yellow dyes produced from the absorption-shifted couplers have low visual density to the human eye. Therefore, the absorption-shifted yellow couplers require the use of higher contrast emulsions. When they are used in rapidly processable photosensitive materials employing silver halides with high chloride contents, sufficiently high contrast and developed color density are not always achieved, so further improvements are desired.

SUMMARY OF THE INVENTION

An object of this invention is to provide a silver halide color photographic material, particularly a color photographic paper, which has excellent color reproducibility, and which has high sensitivity and excellent utility in rapid processing.

A more specific object of this invention is to provide a color photographic paper which allows rapid and stable production of color prints whose color reproduction in the region from yellow to green is improved by the use of a specific yellow coupler.

These and other objects of the invention have been achieved by providing a silver halide color photographic material having at least one silver halide emulsion layer on a reflex support, wherein at least one of the silver halide emulsion layers comprises (i) silver halide grains containing at least 90 mol % silver chloride and having a silver bromide-rich region in the vicinity of at least one grain corner, but having an average bromide content of 15 mol % or less at the grain surface; (ii) at least one coupler represented by the following general formula (I); and (iii) at least one compound represented by the following general formula (II):

(I)

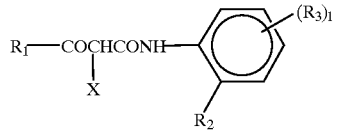

wherein $R_1$ represents an aryl group or a tertiary alkyl group; $R_2$ represents a fluorine atom, an alkyl group, an aryl group, an alkoxy group, an aryloxy group, a dialkylamino group, an alkylthio group, or an arylthio group; $R_3$ represents a group which can replace hydrogen atom of a benzene ring; X represents a hydrogen atom or a group capable of being removed by a coupling reaction with an oxidation product of an aromatic primary amine developing agent; and l represents an integer from 0 to 4, and when l is 2 or more, the $R_3$ groups may be the same or different,

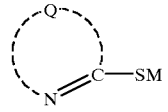

wherein Q represents a group of atoms necessary to complete a 5- or 6-membered hetero ring which may be fused together with a benzene ring; and M represents a hydrogen atom or a cation.

In a preferred embodiment, the silver halide grains in either the foregoing silver bromide-rich region or another region, or in both of them, contain an iridium compound.

DETAILED DESCRIPTION OF THE INVENTION

The coupler of this invention, which is represented by the foregoing general formula (I), is described in detail below.

In general formula (I), $R_1$ preferably represents an aryl group containing 6 to 24 carbon atoms (e.g., phenyl, p-tolyl, o-tolyl, 4-methoxyphenyl, 2-methoxy-phenyl, 4-butoxyphenyl, 4-octyloxyphenyl, 4-hexadecyl-oxyphenyl, 1-naphthyl), or a tertiary alkyl group containing 4 to 24 carbon atoms (e.g., t-butyl, t-pentyl, t-hexyl, 1,1,3,3-tetramethylbutyl, 1-adamantyl, 1,1-dimethyl-2-chloroethyl, 2-phenoxy-2-propyl, bicyclo-[2,2,2]octane-1-yl).

In general formula (I), $R_2$ preferably represents a fluorine atom, an alkyl group containing 1 to 24 carbon atoms (e.g., methyl, ethyl, isopropyl, t-butyl, cyclopentyl, n-octyl, n-hexadecyl, benzyl), an aryl group containing 6 to 24 carbon atoms (e.g., phenyl, p-tolyl, o-tolyl, 4-methoxyphenyl), an alkoxy group containing 1 to 24 carbon atoms (e.g., methoxy, ethoxy, butoxy, n-octyloxy, n-tetradecyloxy, benzyloxy, methoxy-ethoxy), an aryloxy group containing 6 to 24 carbon atoms (e.g., phenoxy, p-tolyloxy, o-tolyloxy, p-methoxy-phenoxy, p-dimethylaminophenoxy, m-pentadecylphenoxy), a dialkylamino group containing 2 to 24 carbon atoms (e.g., dimethylamino, diethylamino, pyrrolidino, piperidino, morpholino), an alkylthio group containing 1 to 24 carbon atoms (e.g., methylthio, butylthio, n-octylthio, n-hexadecylthio), or an arylthio group containing 6 to 24 carbon atoms (e.g., phenylthio, 4-methoxyphenylthio, 4-t-butylphenylthio, 4-dodecylphenyl-thio).

In general formula (I), $R_3$ preferably represents a halogen atom (e.g., fluorine, chlorine, bromine, iodine), an alkyl group containing 1 to 24 carbon atoms (e.g., methyl, t-butyl, n-dodecyl), an aryl group containing 6 to 24 carbon atoms (e.g., phenyl, p-tolyl, p-dodecyloxyphenyl), an alkoxy group containing 1 to 24 carbon atoms (e.g., methoxy, n-butoxy, n-octyloxy, n-tetradecyloxy, benzyloxy, methoxyethoxy), an aryloxy group containing 6 to 24 carbon atoms (e.g., phenoxy, p-t-butylphenoxy, 4-butoxyphenoxy), an alkoxycarbonyl group containing 2 to 24 carbon atoms (e.g., ethoxycarbonyl, dodecyloxycarbonyl, 1-(dodecyloxycarbonyl)ethoxycarbonyl), an aryloxycarbonyl group containing 7 to 24 carbon atoms (e.g., phenoxycarbonyl, 4-t-octyl-phenoxycarbonyl, 2,4-di-t-pentylphenoxycarbonyl), a carbonamido group containing 1 to 24 carbon atoms (e.g., acetamido, pivaloylamino, benzamido, 2-ethylhexanamido, tetradecanamido, 1-(2,4-di-t-pentylphenoxy)butanamido, 3-(2,4-di-t-pentylphenoxy) butanamido, 3-dodecylsulfonyl-2-methylpropanamido), a sulfonamido group containing 1 to 24 carbon atoms (e.g., methanesulfonamido, p-toluenesulfonamido, hexadecanesulfonamido), a carbamoyl group containing 1 to 24 carbon atoms (e.g., N-methylcarbamoyl, N-tetradecylcarbamoyl, N,N-dihexylcarbamoyl, N-octadecyl-N-methylcarbamoyl, N-phenylcarbamoyl), an alkylsulfonyl group containing 1 to 24 carbon atoms (e.g., methylsulfonyl, benzylsulfonyl, hexadecylsulfonyl), an arylsulfonyl group containing 6 to 24 carbon atoms (e.g., phenylsulfonyl, p-tolylsulfonyl, p-decylphenylsulfonyl, p-methoxyphenylsulfonyl), a ureido group containing 1 to 24 carbon atoms (e.g., 3-methylureido, 3-phenylureido, 3,3-dimethylureido, 3-tetradecylureido), a sulfamoylamino group containing 0 to 24 carbon atoms (e.g., N,N-dimethylsulfamoylamino), an alkoxycarbonylamino group containing 2 to 24 carbon atoms (e.g., methoxycarbonylamino, isobutoxycarbonylamino, dodecyloxycarbonylamino), a nitro group, a heterocyclic group containing 1 to 24 carbon atoms (e.g., 4-pyridyl, 2-thienyl, phthalimido, octadecylsuccinimido), a cyano group, an acyl group containing 1 to 24 carbon atoms (e.g., acetyl, benzoyl, dodecanoyl), an acyloxy group containing 1 to 24 carbon atoms (e.g., acetoxy, benzoyloxy, dodecanoyloxy), an alkylsulfonyloxy group containing 1 to 24 carbon atoms (e.g., methylsulfonyloxy, hexadecylsulfonyloxy), or an arylsulfonyloxy group containing 6 to 24 carbon atoms (e.g., p-toluenesulfonyloxy, p-dodecylphenylsulfonyloxy).

In general formula (I), l is preferably 1 or 2.

In general formula (I), X is preferably a group capable of being removed by a coupling reaction with an oxidation product of an aromatic primary amine developing agent (hereinafter abbreviated as "leaving group"), with specific examples including a halogen atom (e.g., fluorine, chlorine, bromine, iodine), a heterocyclic group containing 1 to 24 carbon atoms which is attached to the active coupling site via a nitrogen atom, an aryloxy group containing 6 to 24 carbon atoms, an arylthio group containing 6 to 24 carbon atoms (e.g., phenylthio, p-t-butylphenylthio, p-chlorophenylthio, p-carboxyphenylthio), an acyloxy group containing 1 to 24 carbon atoms (e.g., acetoxy, benzoyloxy, dodecanoyloxy), an alkylsulfonyloxy group containing 1 to 24 carbon atoms (e.g., methylsulfonyloxy, butylsulfonyloxy, dodecylsulfonyloxy), an arylsulfonyloxy group containing 6 to 24 carbon atoms (e.g., benzenesulfonyloxy, p-chlorophenylsulfonyloxy), and a heterocyclic oxy group containing 1 to 24 carbon atoms (e.g., 3-pyridyloxy, 1-phenyl-1,2,3,4-tetrazole-5-yloxy). Among these groups, a heterocyclic group attached to the active coupling site via a nitrogen atom and an aryloxy group are preferred over others.

When X represents a nitrogen-containing heterocyclic group which is attached to the active coupling site via a nitrogen atom, the hetero ring has from 5 to 7 atoms; may contain another hetero atom selected from among oxygen, sulfur, nitrogen, phosphorus, selenium and tellurium; may be substituted; and may be fused together with another ring. Specific examples of such a hetero ring as described above include succinimide, maleimide, phthalimide, diglycolimide, pyrrole, pyrazole, imidazole, 1,2,4-triazole, tetrazole, indole, benzopyrazole, benzimidazole, benzotriazole, imidazolidine-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, and 2-pyrazone. These hetero rings may have one or more substituent groups, such as a hydroxyl group, a carboxyl group, a sulfo group, an amino group (e.g., amino, N-methylamino, N,N-dimethylamino, N,N-diethylamino, anilino, pyrrolidino, piperidino, morpholino), or those groups which are cited as examples of $R_3$.

When X represents an aryloxy group, it contains from 6 to 24 carbon atoms and may be substituted by a group selected from among those cited as examples of substituents for X when X is a heterocyclic group. Preferable substituents for X when X is an aryloxy group include a carboxyl group, a sulfo group, a cyano group, a nitro group, an alkoxycarbonyl group, a halogen atom, a carbonamido group, a sulfonamido group, a carbamoyl group, a sulfamoyl group, an alkyl group, an alkylsulfonyl group, an arylsulfonyl group, and an acyl group.

Among the groups cited above as examples of $R_1$, $R_2$, $R_3$ and X respectively, particularly preferred groups are described below.

In general formula (I), $R_1$ is particularly preferably a 2- or 4-alkoxyaryl group (e.g., 4-methoxyphenyl, 4-butoxyphenyl, 2-methoxyphenyl) or a t-butyl group. $R_1$ is most preferably a t-butyl group.

In general formula (I), $R_2$ is particularly preferably a methyl group, an ethyl group, an alkoxy group, an aryloxy group, or a dialkylamino group. $R_2$ is most preferably a methyl group, an ethyl group, an alkoxy group, an aryloxy group, or a dimethylamino group.

In general formula (I), $R_3$ is particularly preferably an alkoxy group, a carbonamido group, or a sulfonamido group.

In general formula. (I), X is particularly preferably a heterocyclic group attached to the active coupling site via a nitrogen atom, or an aryloxy group.

When X represents a heterocyclic group as described above, it is preferably represented by the following general formula (III):

(III)

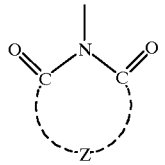

In general formula (III), Z represents

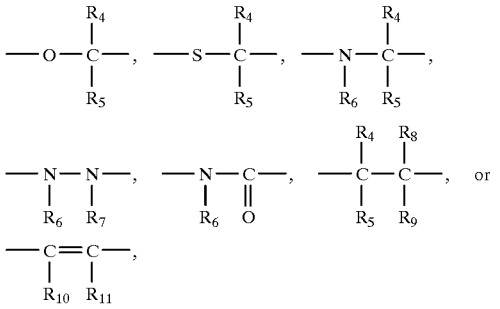

wherein, $R_4$, $R_5$, $R_8$ and $R_9$ each represents a hydrogen atom, an alkyl group, an aryl group, an alkoxy group, an aryloxy group, an alkylthio group, an arylthio group, an alkylsulfonyl group, an arylsulfonyl group, or an amino group. $R_6$ and $R_7$ each represents a hydrogen atom, an alkyl group, an aryl group, an alkylsulfonyl group, an arylsulfonyl group, or an alkoxycarbonyl group. $R_{10}$ and $R_{11}$ each represents a hydrogen atom, an alkyl group, or an aryl group. Also, $R_{10}$ and $R_{11}$ may combine with each other to form a benzene ring. Further, $R_4$ and $R_5$, $R_5$ and $R_6$, $R_6$ and $R_7$, or $R_4$ and $R_8$ may combine with each other to form a ring (e.g., cyclobutane, cyclohexane, cycloheptane, cyclohexene, pyrrolidine, piperidine).

Among the heterocyclic groups represented by general formula (III), those containing as Z a moiety of

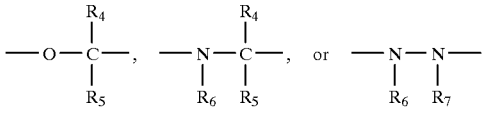

are favored over others.

The total number of carbon atoms contained in a heterocyclic group represented by general formula (III) ranges from 2 to 24, preferably from 4 to 20, and more preferably from 5 to 16. Specific examples of heterocyclic groups represented by general formula (III) include a succinimido group, a maleimido group, a phthalimido group, a 1-methylimidazolidine-2,4-dione-3-yl group, a 1-benzylimidazolidine-2,4-dione-3-yl group, a 5,5-dimethyloxazolidine-2,4-dione-3-yl group, a 5-methyl-5-propyloxazolidine-2,4-dione-3-yl group, a 5,5-dimethylthiazolidone-2,4-dione-3-yl group, a 5,5-dimethylimidazolidine-2,4-dione-3-yl group, a 3-methylimidazolidinetrion-1-yl group, a 1,2,4-triazolidine-3,5-dione-4-yl group, a 1-methyl-2-phenyl-1,2,4-triazolidine-3,5-dione-4-yl group, a 1-benzyl-2-phenyl-1,2,4-triazolidine-3,5-dione-4-yl group, a 5-hexyloxy-1-methylimidazolidine-2,4-dione-3-yl group, a 1-benzyl-5-ethoxyimidazolidine-2,4-dione-3-yl group, and a 1-benzyl-5-dodecylimidazolidine-2,4-dione-3-yl group.

Among the above-cited groups, an imidazolidine-2,4-dione-3-yl group (e.g., 1-benzylimidazolidine-2,4-dione-3-yl) is most preferred.

When X represents an aryloxy group, most preferred groups include a 4-carboxyphenoxy group, a 4-methylsulfonylphenoxy group, a 4-(4-bezyloxyphenylsulfonyl)phenoxy group, a 4-(4-hydroxyphenylsulfonyl)phenoxy group, a 2-chloro-4-(3-chloro-4-hydroxyphenylsulfonyl)phenoxy group, a 4-methoxycarbonylphenoxy group, a 2-chloro-4-methoxycarbonylphenoxy group, a 2-acetamido-4-methoxycarbonylphenoxy group, a 4-isopropoxycarbonylphenoxy group, a 4-cyanophenoxy group, a 2-[N-(2-hydroxyethyl)-carbamoyl]phenoxy group, a 4-nitrophenoxy group, a 2,5-dichlorophenoxy group, a 2,3,5-trichlorophenoxy group, a 4-methoxycarbonyl-2-methoxyphenoxy group, and a 4-(3-carboxypropanamido) phenoxy group.

The couplers represented by general formula (I) may form dimers or higher polymers via divalent or higher valent forms of the substituents $R_1$, X or

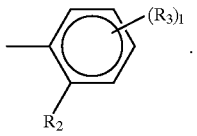

In this case, the total number of carbon atoms contained in each substituent may be out side of the foregoing prescribed ranges.

When the couplers represented by general formula (I) form polymers, typical examples include homo- or copolymers of addition polymerization ethylenic unsaturated compounds containing a yellow dye-forming coupler group. In this case, the polymers contain repeating units of the general formula (IV), wherein the yellow dye-forming repeating units of the general formula (IV) may be the same or different. Also, the copolymers may contain as copolymerizing components one or more non-color-forming ethylenic monomers.

(IV)

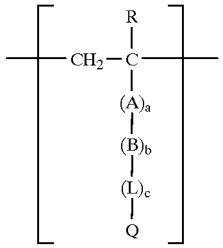

In general formula (IV), R represents a hydrogen atom, an alkyl group containing from 1 to 4 carbon atoms, or a chlorine atom; A represents —CONH—, —COO—, or a substituted or unsubstituted phenylene group; B represents a substituted or unsubstituted alkylene, phenylene or aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represents 0 or 1; and Q represents a yellow coupler group formed by eliminating a hydrogen atom from

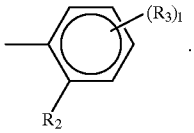

As for the polymers, copolymers produced from yellow color-forming monomers represented by the coupler units of formula (IV) and the non-color-forming ethylenic monomers described below are preferably employed.

Suitable examples of non-color-forming ethylenic monomers which cannot couple with the oxidation products of aromatic primary amine developing agents include acrylic acid, α-chloroacrylic acid, α-alkylacrylic acids (such as methacrylic acid), amides or esters derived from the above-cited acrylic acids (such as acrylamide, methacrylamide, n-butylacrylamide, t-butylacrylamide, diacetoneacrylamide, methylaerylate, ethylacrylate, n-propylacrylate, n-butylacrylate, t-butylacrylate, isobutylacrylate, 2-ethylhexylacrylate, n-octylacrylate, laurylacrylate, methylmethacrylate, ethylmethacrylate, n-butylmethacrylate, and β-hydroxymethacrylate), vinyl esters (such as vinyl acetate, vinyl propionate, and vinyl laurate), acrylonitrile, metharylonitrile, aromatic vinyl compounds (such as styrene, and its derivatives, e.g., vinyltoluene, divinylbenzene, vinylacetophenone and sulfostyrene), itaconic acid, citraconic acid, crotonic acid, vinylidene chloride, vinyl alkyl ethers (such as vinyl ethyl ether), maleic acid esters, N-vinyl-2-pyrrolidone, N-vinylpyridine, and 2- and 4-vinylpyridines.

Among these monomers, acrylates, methacrylates and maleates are particularly preferred. Also, two or more of the non-color-forming ethylenic monomers can be used together. For instance, the combined use of methylacrylate with butylacrylate, that of butylacrylate with styrene, that of butylmethacrylate with methacrylic acid, and that of methylacrylate with diacetoneacrylamide, is acceptable.

As is known in the field of polymer couplers, ethylenic unsaturated monomers to be copolymerized with the vinyl monomers corresponding to the foregoing general formula (IV) are selected so as to exert desirable influences upon the physical and/or chemical properties of the copolymers to be formed, e.g., solubility; compatibility with a binder of a photographic colloid composition, e.g., gelatin; and flexibility and thermal stability of the photographic colloid composition.

The polymeric yellow couplers to be used in this invention may be prepared by dissolving in an organic solvent an oleophilic polymer coupler obtained by polymerization of the vinyl monomers which provide the coupler units represented by the foregoing general formula (IV), and then dispersing the resulting solution into an aqueous gelatin solution in the form of a latex; or they may be prepared directly using an emulsion polymerization method.

As for the methods of dispersing oleophilic polymer couplers in the form of an emulsion into an aqueous gelatin solution, those described in U.S. Pat. No. 3,451,820 can be employed. As for emulsion polymerization methods, the methods described in U.S. Pat. No. 4,080,211 and 3,370,952 can be used.

Specific examples of the substituents $R_3$ and X in the yellow dye-forming couplers represented by general formula (I) are illustrated below. However, the invention should not be construed as being limited to these examples.

Specific examples of the substituent X are shown below:

(1)

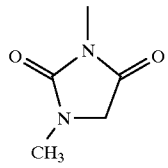

(2)

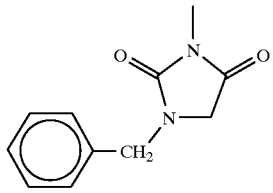

(3)

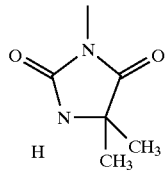

(4)

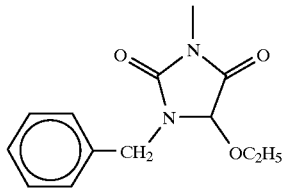

(5)

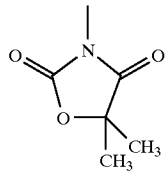

(6)

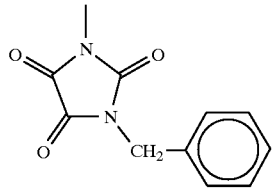

(7)

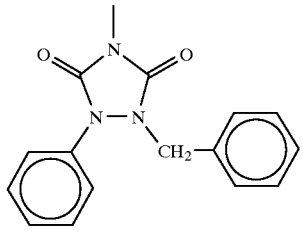

-continued
(8)
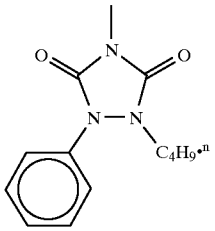
(9)
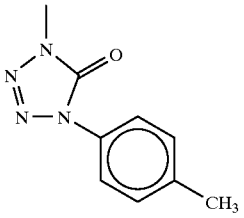
(10)
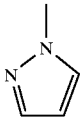
(11)
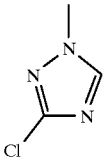
(12)
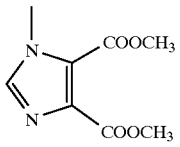
(13)
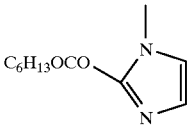
(14)
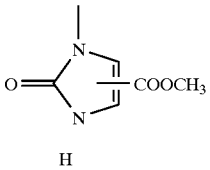
(15)
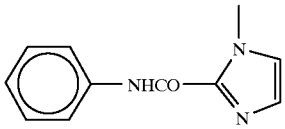
-continued
(16)
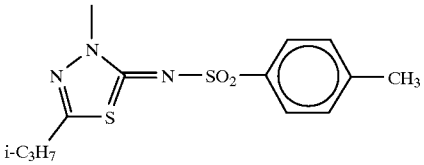
(17)
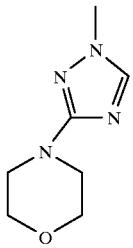
(18)
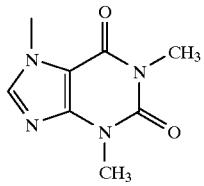
(19)
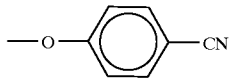
(20)
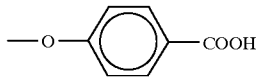
(21)
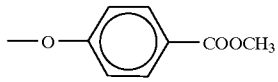
(22)
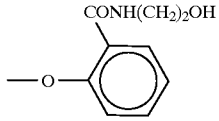
(23)
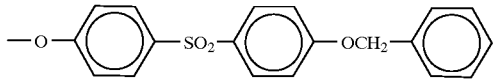
(24)
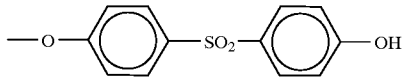
(25)
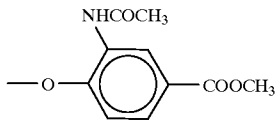

Specific examples of the substituent $R_3$ are shown below:
(30)
$-NHCOC_{13}H_{27}$-n
(31)
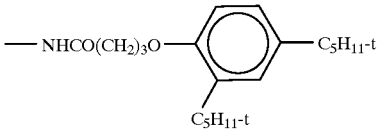
(32)
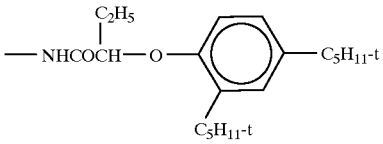
(33)
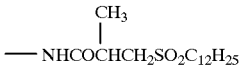
(34)
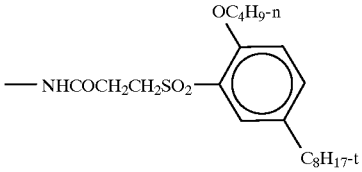
(35)
$-OC_{16}H_{33}$-n
(36)
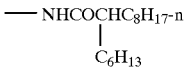
(37)
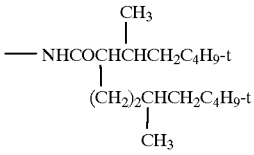
-continued
(38)
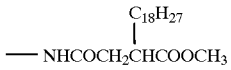
(39)
$-NHSO_2C_{12}H_{25}$-n
(40)
$-NHSO_2C_{16}H_{33}$-n
(41)
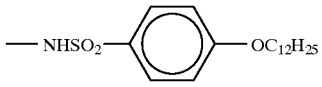
(42)
$-COOC_{12}H_{25}$
(43)
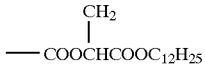
(44)
$-CONHC_{14}H_{29}$
(45)
$-OC_8H_{17}$-n
(46)
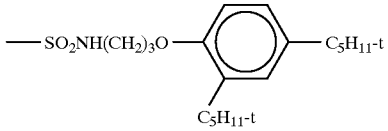
(47)
$-CONH(CH_2)_3OC_{12}H_{25}$
(48)
$-NHCOC_{15}H_{31}$-n
Specific examples of the yellow dye-forming couplers represented by general formula (I) are shown below.
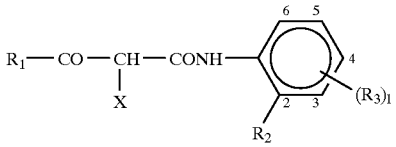
| No. | $R_1$ | $R_2$ | $(R_3)_l$ | X |
|---|---|---|---|---|
| Y-1 | t-$C_4H_9$— | —$OCH_3$ | (32) [5] | (4) |
| Y-2 | t-$C_4H_9$— | —$OCH_3$ | (32) [5] | (5) |
| Y-3 | t-$C_4H_9$— | —$CH_3$ | (31) [5] | (2) |
| Y-4 | t-$C_4H_9$— | 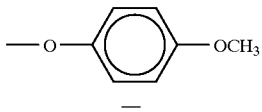 | (32) [5] | (5) |

-continued
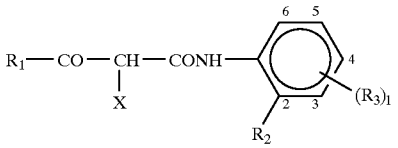
| No. | $R_1$ | $R_2$ | $(R_3)_l$ | X |
|---|---|---|---|---|
| Y-5 | t-$C_4H_9$— | 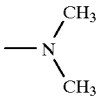 | (32) [5] | (4) |
| Y-6 | t-$C_4H_9$— | —$OCH_3$ | (33) [5] | (8) |
| Y-7 | t-$C_4H_9$— | —$OC_2H_5$ | (33) [5] | (7) |
| Y-8 | t-$C_4H_9$— | —$OCH_3$ | (31) [5] | (23) |
| Y-9 | t-$C_4H_9$— | 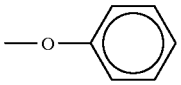 | (40) [5] | (19) |
| Y-10 | t-$C_4H_9$— | —$OC_8H_{17}$-n | (45) [4] | (5) |
| Y-11 | t-$C_4H_9$— | —$OC_8H_{17}$-n | (45) [5] | (5) |
| Y-12 | t-$C_4H_9$— | —$OCH_3$ | (42) [5] | (4) |
| Y-13 | t-$C_4H_9$— | 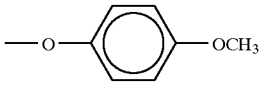 | (30) [5] | (10) |
| Y-14 | t-$C_4H_9$— | —$OC_{14}H_{29}$-n | — | (15) |
| Y-15 | t-$C_4H_9$— | —$OCH_2CH_2OCH_3$ | (34) [5] | (8) |
| Y-16 | t-$C_4H_9$— | —$CH_3$ | (43) [5] | (9) |
| Y-17 | t-$C_4H_9$— | —$C_2H_5$ | (47) [5] | (8) |
| Y-18 | t-$C_4H_9$— | —$OCH_3$ | (46) [5] | (2) |
| Y-19 | t-$C_4H_9$— | —$OC_8H_{17}$-n | (45) [4], (45) [5] | (5) |
| Y-20 | t-$C_4H_9$— | —$OCH_3$ | (31) [5] | (19) |
| Y-21 | t-$C_4H_9$— | 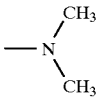 | (36) [4] | (18) |
| Y-22 | t-$C_4H_9$— | 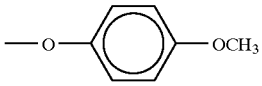 | (41) [5] | (11) |
| Y-23 | t-$C_4H_9$— | 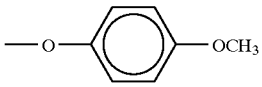 | (37) [5] | (3) |
| Y-24 | t-$C_4H_9$— | —$OC_2H_5$ | (37) [5] | (1) |
| Y-25 | t-$C_4H_9$— | —$CH_3$ | (38) [5] | (2) |
| Y-26 | t-$C_4H_9$— | —$C_2H_5$ | (38) [5] | (2) |
| Y-27 | t-$C_4H_9$— | —$CH_3$ | (33) [5] | (2) |
| Y-28 | 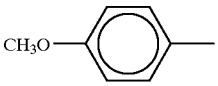 | —$OCH_3$ | (42) [5] | (4) |

-continued

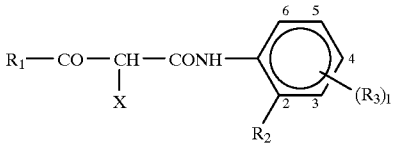

| No. | $R_1$ | $R_2$ | $(R_3)_l$ | X |
|---|---|---|---|---|
| Y-29 | 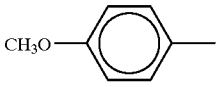 | 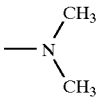 | (40) [5] | (4) |
| Y-30 | 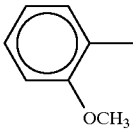 | $—CH_3$ | (43) [5] | (2) |

In the above table, the figures in the parentheses represent the numbers assigned to the specific examples of X and $R_3$ illustrated hereinbefore, respectively. On the other hand, the figures in the square brackets represent the substitution position of $R_3$ on the anilido group, respectively.

The couplers of this invention may be used alone, or as a mixture of two or more thereof, or as a mixture with known yellow dye-forming couplers.

The couplers of this invention, though they can be incorporated in any of the constituent layers of the photographic material, are preferably used in a light-sensitive silver halide emulsion layer or a layer adjacent thereto, and are most preferably used in a light-sensitive silver halide emulsion layer.

The couplers of this invention can be synthesized using hitherto known synthesis methods. As examples of such methods, mention may be made of those disclosed in JP-A-63-123047.

In the photographic material, the couplers of this invention are used in an amount of from $1\times10^{-5}$ to $10^{-2}$ mole, preferably from $1\times^{-4}$ to $5\times10^{-3}$ mole, and more preferably from $2\times10^{-4}$ to $1\times10^{-3}$ mole, per square meter of photographic material.

The yellow couplers of this invention, which are represented by general formula (I) and form yellow dyes by reacting with the oxidation product of an aromatic primary amine color developing agent, are characterized in that the yellow dyes formed therefrom absorb light weakly in the long wavelength region, compared with yellow couplers which have so far been used for color photographic paper.

More specifically, in color prints comprising dyes produced by the reaction of the yellow couplers of this invention with an oxidation product of N-ethyl-N-(β-methanesulfonamidoethyl)-3-methyl-4-aminoaniline, it is desirable that an area having an optical density of 1.0 at the wavelength of the absorption peak of the yellow dye should give such a reflection spectrum that the wavelength at which the reflection density reaches 40% of its peak on the longer wavelength side of the absorption peak of the yellow dye is shorter than 508 nm, preferably shorter than 505 nm, and particularly preferably ranges from 490 nm to 502 nm.

The compounds to be used in this invention which are represented by the general formula (II) are described in detail below.

(II)

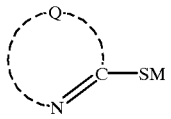

In the above general formula (II), Q represents a group of atoms necessary to complete a 5- or 6-membered hetero ring which may be fused together with a benzene ring, with specific examples including an imidazole ring, a tetrazole ring, a thiazole ring, an oxazole ring, a selenazole ring, a benzimidazole ring, a naphthimidazole ring, a benzothiazole ring, a naphthothiazole ring, a benzoselenazole ring, a naphthoselenazole ring, and a benzoxazole ring.

M represents a cation, such as an alkali metal ion (e.g., sodium ion, potassium ion) or an ammonium ion.

Among the mercapto compounds represented by general formula (II), those represented by the following general formulae (II-1), (II-2), (II-3) and (II-4) are preferred.

(II-1)

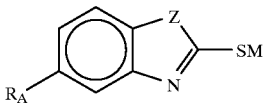

In general formula (II-1), $R_A$ represents a hydrogen atom, an alkyl group, an alkoxy group, an aryl group, a halogen atom, a carboxyl group or its salt, a sulfo group or its salt, or an amino group; Z represents —NH—, —O—, or —S—; and M has the same meaning as in general formula (II).

(II-2)

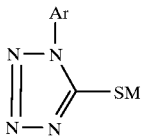

In general formula (II-2), Ar represents

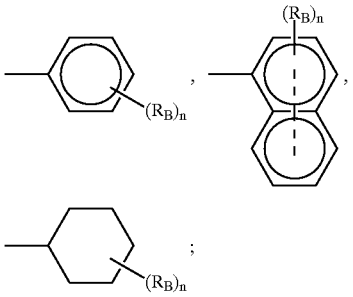

$R_B$ represents an alkyl group, an alkoxy group, a carboxyl group or its salt, a sulfo group or its salt, a hydroxyl group, an amino group, an acylamino group, a carbamoyl group, or a sulfonamido group; n represents an integer from 0 to 2; and M has the same meaning as in general formula (II).

As for the substituent groups $R_A$ and $R_B$ in general formulae (II-1) and (II-2), respectively, examples of an alkyl group include methyl, ethyl, butyl and so on, those of an alkoxy group include methoxy, ethoxy and so on, and those of a salt of a carboxyl group or a sulfo group include a sodium salt, an ammonium salt and so on.

In general formula (II-1), examples of $R_A$ when $R_A$ is an aryl group include phenyl, naphthyl and so on, and examples of $R_A$ when $R_A$ is a halogen atom include chlorine, bromine and so on.

In general formula (II-2), examples of $R_B$ when $R_B$ is an acylamino group include methylcarbonylamino, benzoylamino and so on; examples of $R_B$ when $R_B$ is a carbamoyl group include ethylcarbamoyl, phenylcarbamoyl and so on; and examples of $R_B$ when $R_B$ is a sulfonamido group include methylsulfonamido, phenylsulfonamido and so on.

Each of the foregoing alkyl, alkoxy, aryl, amino, acylamino, carbamoyl and sulfonamido groups may further have a substituent group.

(II-3)

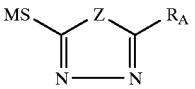

In the above general formula (II-3), Z represents

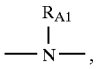

an oxygen atom, or a sulfur atom; $R_A$ represents a hydrogen atom, an alkyl group, an aryl group, an alkenyl group, a cycloalkyl group, —$SR_{A1}$, —$NR_{A2}R_{A3}$, —$NHCOR_{A4}$, —$NHSO_2R_{A5}$, or a heterocyclic group; $R_{A1}$ represents a hydrogen atom, an alkyl group, an alkenyl group, a cycloalkyl group, an aryl group, —$COR_{A4}$ or —$SO_2R_{A5}$; $R_{A2}$ and $R_{A3}$ each represents a hydrogen atom, an alkyl group, or an aryl group; $R_{A4}$ and $R_{A5}$ each represents an alkyl group, or an aryl group; and M has the same meaning as in general formula (II).

Examples of alkyl groups represented by $R_A$, $R_{A1}$, $R_{A2}$, $R_{A3}$, $R_{A4}$ and $R_{A5}$ in general formula (II-3) include methyl, benzyl, ethyl, propyl and so on, and examples of aryl groups represented by the foregoing symbols include phenyl, naphthyl and so on.

An example of an alkenyl group represented by $R_A$ and $R_{A1}$ is a propenyl group, and an example of a cycloalkyl group represented by these symbols is a cyclohexyl group.

Examples of heterocyclic groups represented by $R_A$ are a furyl group, a pyridinyl group and so on.

The alkyl and aryl groups represented by $R_A$, $R_{A1}$, $R_{A2}$, $R_{A3}$, $R_{A4}$ and $R_{A5}$, the alkenyl and cycloalkyl groups represented by $R_A$ and $R_{A1}$, and the heterocyclic group represented by $R_A$ may further have a substituent group.

(II-4)

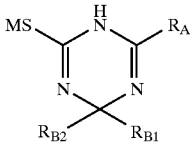

In the a bove general formula (II-4), $R_A$ and M have the same meanings as in general formula (II-3), respectively, and $R_{B1}$ and $RB_2$ have the same meanings as $R_{A1}$ and $R_{A2}$ in general formula (II-3), respectively.

Specific examples of compounds represented by general formula (II) are illustrated below. However, this invention should not be construed as being limited to these examples.

II-1-1

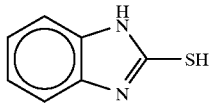

II-1-2

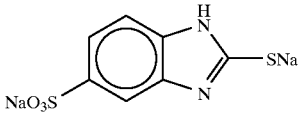

II-1-3

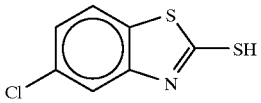

II-1-4

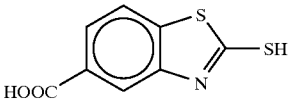

II-1-5

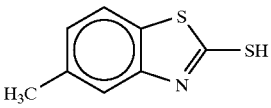

II-1-6

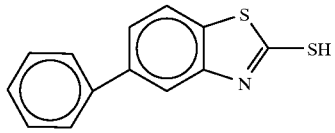

II-1-7

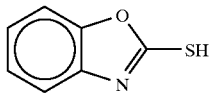

-continued
II-1-8
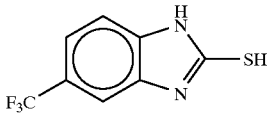
II-2-1
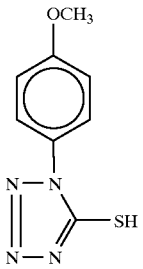
II-2-2
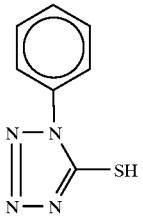
II-2-3
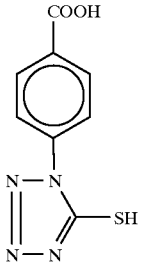
II-2-4
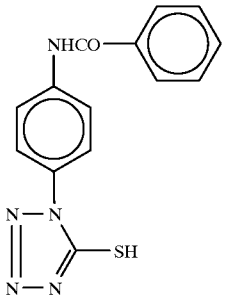
II-2-5
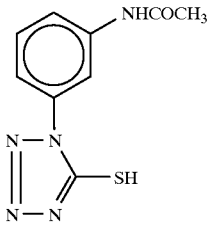
-continued
II-2-6
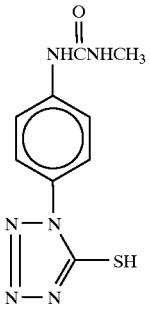
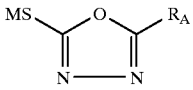
| Compound exemplified | $R_A$ | M |
|---|---|---|
| II-3-1 | $—C_2H_5$ | —H |
| II-3-2 | $—CH_2—CH=CH_2$ | —H |
| II-3-3 | $—CH=CH—CH_2—CH_3$ | —H |
| II-3-4 | $—C_7H_{15}$ | —H |
| II-3-5 | $—C_9H_{19}$ | —Na |
| II-3-6 | 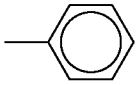 | —H |
| II-3-7 | $—C_4H_9(t)$ | —H |
| II-3-8 | 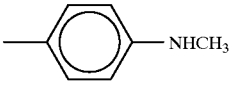 | —H |
| II-3-9 | 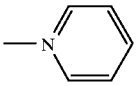 | —H |
| II-3-10 | 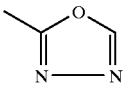 | —H |
| II-3-11 | 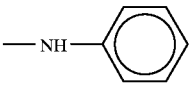 | —H |
| II-3-12 | 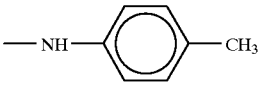 | $—NH_4$ |
| II-3-13 | $—NHCOCH_3$ | —H |
| II-3-14 | 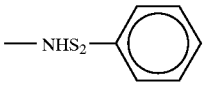 | —H |
| II-3-15 | $—N(CH_3)_2$ | —H |

-continued

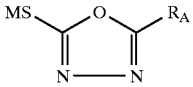

| Compound exemplified | $R_A$ | M |
|---|---|---|
| II-3-16 | —NHCH$_2$— | —H |
| II-3-17 | —CH$_2$— | —H |
| II-3-18 | —S—SH$_3$ | —H |
| II-3-19 | —S— | —H |
| II-3-20 | —SH | —H |

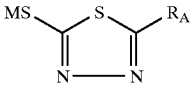

| Compound exemplified | $R_A$ | M |
|---|---|---|
| II-3-21 | —H | —H |
| II-3-22 | —$C_2H_5$ | —H |
| II-3-23 | —$C_4H_9$(t) | —H |

-continued

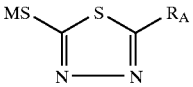

| Compound exemplified | $R_A$ | M |
|---|---|---|
| II-3-24 | —$C_6H_{13}$ | —H |
| II-3-25 | | —H |
| II-3-26 | —$NO_3$ | —H |
| II-3-27 | —$N(CH_3)_2$ | —H |
| II-3-28 | | —H |
| II-3-29 | —NH— | —H |
| II-3-30 | —$NH_2$ | —H |
| II-3-31 | —$CH_2CH$—$CH_2$ | —H |
| II-3-32 | —SH | —H |
| II-3-33 | —$NHCOC_2H_5$ | —H |

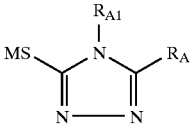

| Compound exemplified | $R_A$ | $R_{A1}$ | M |
|---|---|---|---|
| II-3-34 | —$C_2H_5$ | —H | —H |
| II-3-35 | —$CH_3$ | —$CH_3$ | —H |
| II-3-36 | —$CH_3$ | | —H |
| II-3-37 | —$NHCOCH_3$ | —$CH_3$ | —H |
| II-3-38 | —NHCO— | —CO— | —H |
| II-3-39 | —$NHCOCH_3$ | —$COCH_3$ | —H |

-continued
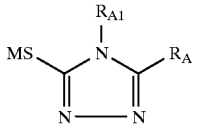
| Compound exemplified | $R_A$ | $R_{A1}$ | M |
|---|---|---|---|
| II-3-40 | —$NHCOCH_3$ | 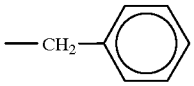 | —H |
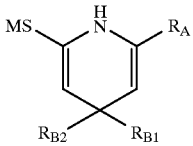
| Compound exemplified | $R_{A1}$ | $R_{B1}$ | $R_{B2}$ | M |
|---|---|---|---|---|
| II-4-1 | —$C_2H_5$ | —$CH_3$ | —$CH_3$ | —H |
| II-4-2 | 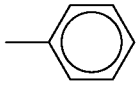 | —$CH_3$ | —$CH_3$ | —H |
| II-4-3 | —$NH_2$ | —H | 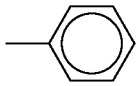 | —H |
| II-4-4 | 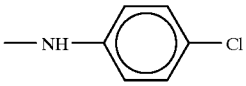 | —H | —$C_4H_9$ | —H |
| II-4-5 | —$NHCOCH_3$ | —$CH_3$ | —$CH_3$ | —H |
| II-4-6 | 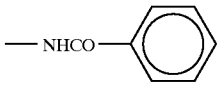 | —$CH_3$ | —$CH_3$ | —H |
| II-4-7 | 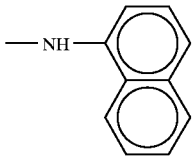 | —$CH_3$ | —$C_3H_7$(i) | —H |
| II-4-8 | 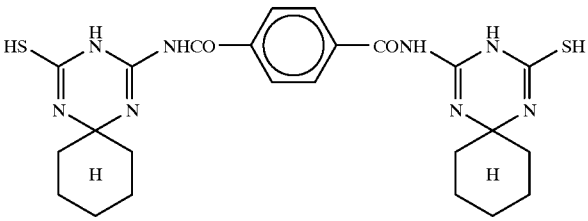 | | | |

Each of the compounds represented by general formula (II) is preferably added in an amount of from $1\times10^{-5}$ to $5\times10^{-2}$ mole, particularly from $1\times10^{-4}$ to $1\times10^{-2}$ mole, per mole of silver halide. The location of which the compound of general formula (II) is to be added is not particularly restricted, and it may be added to any constituent layer, whether or not the layer is light-sensitive. Also, the time at which the compound of general formula (II) is added is not particularly limitated, and it may be added during grain formation, physical ripening or chemical ripening of the silver halide, or during preparation of a coating composition.

A preferred method for making the silver halide emulsion of this invention containing silver halide grains having a bromide-rich region is described in detail below. The expression "vicinity of a corner" as used herein refers to the area of a square the lengths of whose sides are about ⅓ (preferably ⅕) the diameter of a circle having the same area as the projected area of the silver chlorobromide grains having a regular cubic crystal form or an equivalent thereof, and which contains as one of its vertices one corner of each grain (i.e., an intersection of edges of each grain with a regular crystal form of a cube or an equivalent thereof). The proportion of chlorobromide grains having a bromide-rich region to all of the silver halide grains present in the same emulsion layer is preferably 70 mol % or more.

(1) The silver halide host crystals to be used for making the emulsion of this invention are substantially cubic or tetradecahedral grains having (100) faces (which may have roundish corners, and faces of higher orders). The halide compositions used in this invention are silver chlorobromides with a chloride content of 90 mol % or more, or silver chlorides, which may have an iodide content of 2 mol % or less, or no iodide content. The halide composition is preferably silver chlorobromide with a chloride content of 95 mol % or more, especially at least 99 mol %, or pure silver chloride. The average size of the silver halide host grains preferably ranges from 0.2 to 2 $\mu$m and it is desirable that the grain size distribution be monodispersed.

The term "monodispersed emulsion" and used herein refers to an emulsion having such a size distribution that the variation coefficient (S/r) of the silver halide grain size is at most 0.25. Here, r is the average grain size, and S is the standard deviation of the distribution of grain sizes. More specifically, when the number of emulsion grains of size $r_1$ is $n_1$, the average grain size r is defined as $$\bar{r} = \frac{\sum n_i \cdot r_i}{\sum n_i}$$

and the standard deviation S of the distribution of grain sizes is defined as $$S = \sqrt{\frac{\sum (\bar{r} - r_i)^2 \cdot n_i}{\sum n_i}}$$

The term "grain size" as used herein is defined as the diameter of a circle whose area is equal to the projected area of the grain. The grain size is determined from the projected areas of grains by taking photomicrographs of silver halide emulsion grains (usually with the aid of an electron microscope) in manners well-known in the art, as described, e.g., in T. H. James, et al., *The Theory of the Photographic Process*, 3rd. ed., pp. 36–39, Macmillan (1966). The projected-area corresponding diameter used herein is defined as the diameter of a circle having the same area as the projected area of each silver halide grain. Therefore, even in cases where the silver halide grains have a shape other than a sphere (e.g., that of a cube, an octahedron, a tetradecahedron or a tablet, a potato-like form, or so on), it is possible to determine the average grain size r and the standard deviation S thereof in the manner described above.

The variation coefficient of the grain sizes of the silver halide grains is controlled to 0.25 or less, preferably 0.20 or less, more preferably 0.15 or less, and most preferably 0.10 or less.

(2) Bromine ion or fine-grain silver halide with a high bromide content is added to the above-described silver halide host grains to deposit a new silver halide phase which is rich in bromide content on the individual surfaces of the host grains. In the case where bromine ion is added, the process of depositing a new silver halide phase proceeds through an exchange reaction between bromine ion and halogen ions present at the surfaces of the host grains (or so-called halogen conversion). In the other case, wherein a fine-grain silver halide with a high bromide content is added, the above-described process proceeds through a reaction called "recrystallization" which takes place when a strong driving force favoring the formation of crystals with a more stable composition is present as between the host grains and the fine grains with a high bromide content. The recrystallization reaction is distinguished from the conversion reaction. In such a recrystallization reaction, the driving force results from an increase in, entropy. Accordingly, the recrystallization reaction is quite different from Ostwald ripening. These facts are described, e.g., in H. C. Yutzy, *Journal of the American Chemical Society*, 59, p. 916 (1937).

It is surprising that given the substantial differences between these two reactions, both reactions select the vicinity of the corners of host grains as the place to form a new phase richer in silver bromide.

(3) For the purpose of more effectively achieving an object of this Lnvention, which consists in obtaining very high sensitivity through the concentration of latent images or development nuclei, a compound capable of inhibiting or hindering the start of halogen conversion (hereinafter abbreviated as "CR compound") can be employed.

In general, the CR compounds include compounds which can adsorb selectively to a particular crystal face, and thereby can function so as to retard the start of halogen conversion and recrystallization compared with cases which are free from the adsorption of the CR compound; or the CR compound can function so as to completely hinder halogen conversion and recrystallization. In this invention, those compounds which adsorb predominantly (or selectively) to (111) faces and which function so as to inhibit the start of conversion and recrystallization on the (111) faces are preferably employed as the CR compounds.

As examples of CR compounds which can be used in this invention, mention may be made of cyanine dyes, merocyanine dyes, mercaptoazoles (specific examples of which include the compounds described in detail in European Patent 0273430, wherein they are represented by the general formulas (XXI), (XXII) and (XXIII), and so on), and degradation products of nucleic acids (e.g., materials produced in the course of degradation of deoxyribonucleic acid and ribonucleic acid, adenine, guanine, uracil, cytosine, and thymine). Among the CR compounds, the compounds represented by the following general formulas (Is), (IIs) or (IIIs) are particularly preferred.

General Formula (Is)

(Is)

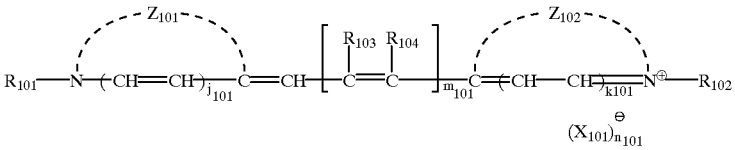

In general formula (Is), $Z_{101}$ and $Z_{102}$ each represents a group of atoms necessary to complete a heterocyclic nucleus.

As for the heterocyclic nucleus, 5- to 6-membered ring nuclei which contain as hetero atoms a nitrogen atom and another hetero atom such as a sulfur, oxygen, selenium or tellurium atom (which may be fused together with another ring, and further may have a substituent group) are preferred.

Specific examples of heterocyclic nuclei as described above include thiazole nuclei, benzothiazole nuclei, naphthothiazole nuclei, selenazole nuclei, benzoselenazole nuclei, naphthoselenazole nuclei, oxazole nuclei, benzoxazole nuclei, naphthoxazole nuclei, imidazole nuclei, benzimidazole nuclei, naphthimidazole nuclei, 4-quinoline nuclei, pyrroline nuclei, pyridine nuclei, tetrazole nuclei, indolenine nuclei, benzindolenine nuclei, indole nuclei, tellurazole nuclei, benzotellurazole nuclei, naphthotellurazole nuclei, and so on.

$R_{101}$ and $R_{102}$ each represents an alkyl group, an alkenyl group, an alkynyl group, or an aralkyl group. These groups and those described below may be substituted. For example, "alkyl group" includes both unsubstituted and substituted alkyl groups.

The alkyl group may assume a straight-chain, branched or cyclic form. Further, the number of carbon atoms contained in the alkyl group is preferably from 1 to 8.

As examples of substituent groups which the substituted alkyl group may have, mention may be made of a halogen atom (e.g., chlorine, bromine, fluorine), a cyano group, an alkoxy group, a substituted or unsubstituted amino group, a carboxyl group, a sulfo group, a hydroxyl group and so on. One of these substituents may replace one hydrogen of the alkyl group, or two or more of them may replace a corresponding number of alkyl hydrogens.

An example of an alkenyl group is a vinylmethyl group.

Examples of an aralkyl group are a benzyl group and a phenethyl group.

$m_{101}$ represents 0 or a positive integer from 1 to 3.

When $m_{101}$ represents 1, $R_{103}$ represents a hydrogen atom, a lower alkyl group, an aralkyl group, or an aryl group. Examples of an aryl group include substituted and unsubstituted phenyl groups. $R_{104}$ represents a hydrogen atom.

When $m_{101}$ represents 2 or 3, $R_{103}$ represents a hydrogen atom; and $R_{104}$ represents a hydrogen atom, a lower alkyl group or an aralkyl group and further can combine with $R_{102}$ to form a 5- or 6-membered ring. Furthermore, $R_{103}$ may combine with another $R_{103}$ to form a hydrocarbon or a heterocyclic ring when $m_{101}$ represents 2 or 3 and $R_{104}$ represents a hydrogen atom. Such rings are preferably 5- or 6-membered.

$j_{101}$ and $k_{101}$ each represents 0 or 1, $X_{101}^-$ represents an acid anion, and $n_{101}$ represents 0 or 1.

General Formula (IIs)

(IIs)

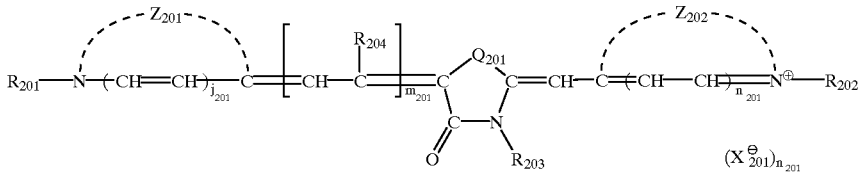

In general formula (IIs), $Z_{201}$ and $Z_{202}$ have the same meanings as the foregoing $Z_{101}$ and $Z_{102}$, respectively. $R_{201}$ and $R_{202}$ have the same meanings as the foregoing $R_{101}$ and $R_{102}$, respectively. $R_{203}$ represents an alkyl group, an alkenyl group, an alkynyl group, or an aryl group (e.g., a substituted or unsubstituted phenyl group). $m_{201}$ represents 0, 1 or 2. $R_{204}$ represents a hydrogen atom, a lower alkyl group or an aryl group. In addition, one $R_{204}$ group may combine with the other $R_{204}$ group to form a hydrocarbon or hetero ring when $m_{201}$ represents 2. These rings are preferably 5- or 6-membered.

$Q_{201}$ represents a sulfur atom, an oxygen atom, a selenium atom, or $=N-R_{205}$. $R_{205}$ has the same meaning as $R_{203}$. $j_{201}$, $k_{201}$, $X_{201}^{\ominus}$ and $n_{201}$ have the same meanings as $j_{101}$, $k_{101}$, $X_{101}^{\ominus}$ and $n_{101}$, respectively.

General formula (IIIs)

(IIIs)

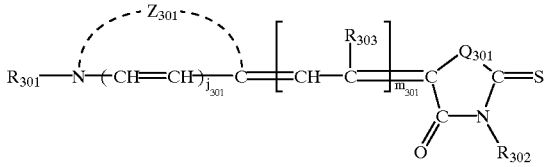

In general formula (IIIs), $Z_{301}$ represents a group of atoms necessary to complete a heterocyclic ring. Examples of such a heterocyclic ring include those described with regard to $Z_{101}$ and $Z_{102}$, and further include thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline, naphthoimidazoline and like nuclei. $Q_{301}$ has the same meaning as $Q_{201}$. $R_{301}$ has the same meaning as $R_{101}$ or $R_{102}$, and $R_{302}$ has the same meaning as $R_{203}$. $m_{301}$ has the same meaning as $m_{201}$. $R_{303}$ has the same meaning as $R_{204}$, and $R_{303}$ further may combine with another $R_{3303}$ to form a hydrocarbon or heterocyclic ring when $m_{301}$ represents 2 or 3. $j_{301}$ has the same meaning as $j_{101}$.

Besides functioning to enhance the selectivity of the initial place for formation of a new phase richer in silver bromide than the host grains, the CR compounds prevent the above-described new phase from spreading over the entire surface of the host grains and forming a uniform new layer through repeated recrystallization between the new phase and the host grain surface. The CR compounds thus promote the formation of the new silver bromide-rich phase through epitaxial growth and the retention thereof in an area restricted to the vicinity of the corner(s) of each host grain. It is surprising that the realization of very high sensitivity, which is an object of this invention, can be achieved by the formation of the new phase in a restricted area.

However, heightening the sensitivity in the above-described manner is accompanied with an increase in susceptibility to pressure desensitization. The term pressure desensitization refers to the phenomenon which occurs when pressure is applied to a sensitive material before exposure and the sensitivity of the area to which pressure has been applied is decreased. Since the increase in the bromide content in the new phase which is richer in bromide than the host grains tends to make the condition of pressure desensitization worse, it is desirable that the bromide content in the new phase be higher than that in the host grains, but 90 mol % or less, preferably 60 mol % or less.

A desirable size of the fine-grain emulsion with a high bromide content which can be used in this invention is generally 0.3 $\mu$m or less, preferably 0.1 $\mu$m or less, though it depends on the size and the halide composition of the host grains.

As for the halide composition, it is essential for the fine-grain emulsion to have a bromide content higher than that of the host grains. Therefore, it is desirable that the fine-grain emulsion should have a bromide content of 50 mol % or more, particularly 70 mol % or more.

The fine-grain emulsion with a high bromide content can contain silver iodide, if desired. Further, it can contain ions or compounds of heavy metals, such as iridium, rhodium, platinum and the like.

The fine-grain high bromide content emulsion is mixed with host grains of silver halide. The proportion of the fine-grain emulsion in the mixture ranges from 50% to 0.1%, preferably 0.2% to 20%, and particularly preferably from 0.2% to 8%, based on silver. The mixing temperature can be chosen freely within the range from 30° C. to 80° C.

Each of the silver halide grains of this invention contains on the average at least 90 mol % silver chloride, and has a new phase which is richer in silver bromide than its host grain, which is formed through epitaxial growth in the vicinity of corner(s) of each host grain, and may further have a region in which there is a gradual change in halide composition between the new phase and the host grain. Such a grain structure as described above can be observed with various analytical means. For example, the presence of the junction of the new phase with each host grain in the vicinity of the corner(s) of the host grain can be confirmed by observing the change in grain shape under an electron microscope.

The halide compositions of the host grains and the new phase can be determined by an X-ray diffraction method.

The average halide composition at the grain surface can be examined by an XPS method (X-ray Photoelectron Spectroscopy) using, e.g., an ESCA Model 750 spectrometer, produced by Shimazu—du Pont Co. Techniques of the XPS method are described in detail, e.g., in Someno et al., *Surface Analyses*, Kodansha, Tokyo (1977).

From an examination of the halide compositions of the host grains and the new phase using an X-ray diffraction method, and an examination of the average halide composition of the grain surface using an XPS method, the proportion of the area occupied by the new phase which is richer in silver bromide than each host grain to the entire surface area can be estimated.

Further, to locate the new phase which is richer in silver bromide than each host grain, and to determine the proportion of the area occupied by the new phase in the vicinities of each grain corner, a measurement by an EDX (Energy Dispersive X-ray analysis) method using an EDX spectrometer installed in a transmission electron microscope can be made, in addition to the above-described observation under an electron microscope. Techniques of this measurement are described in detail, e.g., in Hiroyoshi Soejima, *Electron-Beam Microanalysis*, Nikkan Kogyo Shinbun-sha (1987).

It is desirable that the new phase of this invention should be localized in the vicinity of the corner(s) of each host grain, and the average halide composition at the grain surface should comprise 15 mole percent silver bromide or less, preferably 10 mole percent silver bromide or less. An increase in the average bromide content at the grain surface implies a decrease in the degree of localization of the new phase in the vicinity of the corners, and results in a lowering of the sensitivity.

It has been observed using an electron microscope that the epitaxial junction and growth of the new phase formed in the manner preferred in this invention takes place on the corner part of each host grain.

In the silver chlorobromide emulsion prepared in accordance with this invention, the latent image or development centers are concentrated at points, so very high sensitivity can be achieved and the stability of the sensitivity is remarkably improved, and fog generation can be suppressed without impairing the rapid processability of the emulsion. Moreover, it is surprising that a high contrast emulsion can be obtained, and the emulsion has the advantages that pressure desensitization hardly occurs and generation of fog in the unexposed areas is reduced.

The CR compounds to be used in this invention can be chosen from sensitizing dyes. In particular, those useful for (100) surfaces can be selected from among the compounds represented by the foregoing general formulas (Is), (IIs) or (IIIs). Since these compounds can also function as sensitizing dyes, the use thereof is also favorable for increasing spectral sensitivities. Further, the increased spectral sensitivities can be stabilized through partial recrystallization at the grain surface. The discovery of these excellent combinations and the effects produced therefrom are surprising.

With the intention of further enhancing their effects in increasing sensitivity and stability, the above-cited CR compounds may be used in combination with other sensitizing dyes, and may also be used in combination with supersensitizing agents.

For example, aminostilbene compounds substituted by nitrogen-containing heterocyclic groups (e.g., the compounds of general formula (I), especially those illustrated as specific compound examples (I-1) to (I-17), disclosed in JP-A-62-174738; and the compounds disclosed in U.S. Pat. Nos. 2,933,390 and 3,635,721), aromatic organic acid-formaldehyde condensates (e.g., those disclosed in U.S. Pat. No. 3,743,510), cadmium salts, azaindene compounds and so on can be used to further enhance the effects of the CR compounds. Particularly useful combinations are disclosed in U.S. Pat. Nos. 3,615,613, 3,615,641, 3,617,295 and 3,635,721.

As specific examples of the CR compounds represented by general formulae (Is), (IIs) and (IIIs), mention may be made of the compounds illustrated in European Patent 0273430, from CR-1 to CR-55.

For the purpose of further enhancing the effects of this invention, for example, in preventing lowering contrast and sensitivity, it is desirable to incorporate an iridium compound in an amount of from $10^{-8}$ to $10^{-5}$ mole per mole of silver into the silver halide grains of this invention, which have a high chloride content and bromide-rich areas.

The color photographic light-sensitive material of this invention can comprise a support having thereon at least one blue-sensitive silver halide emulsion layer, at least one green-sensitive silver halide emulsion layer, and at least one red-sensitive silver halide emulsion layer. In a general color photographic paper, the silver halide emulsion layers are usually coated on the support in the above-described order. However, coating orders different from the foregoing one may be adopted. Also, infrared-sensitive silver halide emulsion layers may be provided in the place of at least one of the foregoing emulsion layers. Color reproduction according to the subtractive color process can be effected by incorporating the combinations of silver halide emulsions having sensitivities in their respective wavelength regions with color couplers capable of forming dyes, each of which bears a complementary color relationship to the light by which its corresponding emulsion is sensitized, that is to say, the relationship of a yellow dye to blue light, that of a magenta dye to green light, or that of a cyan dye to red light, in the foregoing light-sensitive silver halide emulsion layers, respectively. However, different correspondences of sensitizing light to hue of developed color may be adopted.

The average size of the silver halide grains other than those having a bromide-rich region, contained in the silver halide emulsions to be used in this invention (the grain size herein refers to the diameter of a circle having the same area as the projected area of each grain, and the number average is taken in expressing the grain size) ranges preferably from 0.1 to 2 $\mu$.

As for the distribution of sizes among grains, a so-called monodispersed emulsion which has a variation coefficient (the value obtained by dividing the standard deviation of the grain size distribution by the average grain size) of 20% or less, desirably 15% or less, is preferred. For the purpose of obtaining a wide latitude, it is advantageous to coat a blend of two or more monodispersed emulsions differing in average grain size in a single layer, or to coat them separately in a multiple layer.

The silver halide grains other than those having a bromide-rich region in the photographic emulsions may have a regular crystal form, such as that of a cube, a tetradecahedron or an octahedron, or can have a tabular from. A mixture of silver halide grains having different forms can be used.

Also, it is desirable in this invention to use such an emulsion which contains tabular silver halide grains wherein that the proportion of tabular silver halide grains having an average aspect ratio (the ratio of the projected area diameter to the thickness) of 5 or more, preferably 8 or more, to all of the silver halide grains in the emulsion is more than 50%, based on the projected area.

The silver chlorobromide emulsion to be used in this invention other than that containing silver chlorobromide grains having a bromide-rich region can be prepared using various methods as described in, for example, P. Glafkides, *Chemie et Phisique Photographique*, Paul Montel, Paris (1967), G. F. Duffin, *Photographic Emulsion Chemistry*, The Focal Press, London (1966), V. L. Zelikman et al, *Making and Coating Photographic Emulsions*, The Focal Press, London (1964); and so on. Specifically, any process including an acid process, a neutral process or an ammoniacal process may be employed.

Suitable methods for reacting a water-soluble silver salt with a water-soluble halide include, e.g., the single jet method, the double jet method, or a combination thereof. Also, a method in which silver halide grains are produced in the presence of excess silver ion (the so-called reverse mixing method) can be employed. On the other hand, the so-called controlled double jet method in which the pAg of the liquid phase in which silver halide grains are to be precipitated is maintained constant, may be also employed. According to this method, a silver halide emulsion having a regular crystal form and an almost uniform grain size distribution can be obtained.

In the process of producing the silver halide grains having a bromide-rich region and other silver halide grains or allowing the produced silver halide grains having, a bromide-rich region and other silver halide grains to ripen physically, various kinds of polyvalent metal ion impurities can be introduced. Examples of compounds include cadmium salts, zinc salts, lead salts, copper salts, thallium salts, and single or complex salts of Group VIII elements, such as iron, ruthenium, rhodium, palladium, osmium, iridium, platinum, etc. Among these salts, those of Group VIII elements are used to advantage. The amount of these compounds to be added, though it can be varied over a wide range depending on the purpose, is preferably within the range of $10^{-9}$ to $10^{-2}$ mole per mole of silver halide.

The silver halide emulsions used in this invention are, in general, chemically and spectrally sensitized.

Chemical sensitization can be effected using a sulfur sensitization process comprising the addition of an unstable sulfur compound, a sensitization process utilizing a noble metal compound represented by a gold compound, and a reduction sensitization process, individually or as a combination of thereof. Compounds which are preferably used in this invention for chemical sensitization include those disclosed in JP-A-62-215272, from the right lower column on page 18 to the right upper column on page 22.

The silver halide emulsions used in this invention can contain a wide variety of compounds or precursors thereof for the purpose of preventing fog or stabilizing photographic functions during production, storage, or photographic processing. Specific examples of such compounds which can preferably be used in this invention include those disclosed in the above-cited patent, JP-A-62-215272, from page 39 to page 72.

When this invention is applied to color photographic emulsions, a yellow coupler, a magenta coupler and a cyan coupler which form yellow, magenta and cyan colors respectively upon coupling with an oxidation product of an aromatic amine type color developing agent are generally incorporated in the photographic material.

Cyan and magenta couplers which can preferably be used in this invention are those represented by the following general formulae (C-I), (C-II), (M-I) and (M-II).

(C-I)

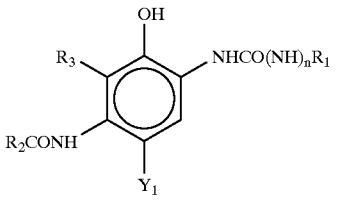

(C-II)

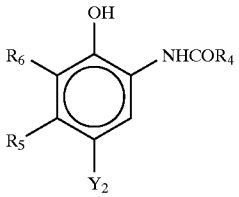

(M-I)

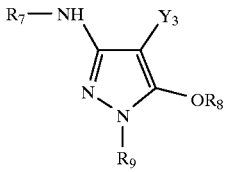

(M-II)

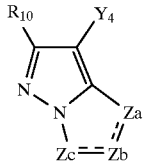

In general formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group, or an acylamino group; and further, $R_3$ may represent a group of nonmetal atoms necessary to complete a nitrogen-containing 5- or 6-membered ring by combining with $R_2$. $Y_1$ and $Y_2$ each represents a hydrogen atom, or a group capable of being removed upon a coupling reaction with an oxidation product of a developing agent. n represents 0 or 1.

$R_5$ in general formula (C-II) is preferably an aliphatic group, with specific examples including methyl, ethyl, propyl, butyl, pentadecyl, tert-butyl, cyclohexyl, cyclohexylmethyl, phenylthiomethyl, dodecyloxyphenylthiomethyl, butanamidomethyl, methoxymethyl, and so on.

Preferred cyan couplers among those represented by the foregoing general formulae (C-I) and (C-II) are described in more detail below.

$R_1$ in general formula (C-I) is preferably an aryl or heterocyclic group, and more preferably an aryl group substituted by one or more of a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When $R_3$ and $R_2$ in general formula (C-I) do not combine with each other to form a ring, $R_2$ is preferably a substituted or unsubstituted alkyl or aryl group, and more preferably a substituted aryloxy-substituted alkyl group, and $R_3$ is preferably a hydrogen atom.

$R_4$ in general formula (C-II) is preferably a substituted or unsubstituted alkyl or aryl group, and particularly preferably a substituted aryloxy-substituted alkyl group.

$R_5$ in general formula (C-II) is preferably an alkyl group containing from 2 to 15 carbon atoms, or a methyl group substituted by a group containing at least one carbon atom. Suitable examples of such a substituent include an arylthio group, an alkylthio group, an acylamino group, an aryloxy group and an alkylthio group.

In general formula (C-II), $R_5$ is more preferably an alkyl group containing 2 to 15 carbon atoms, especially 2 to 4 carbon atoms.

$R_6$ in general formula (C-II) is preferably a hydrogen atom or a halogen atom, and particularly preferably a chlorine atom or a fluorine atom.

$Y_1$ and $Y_2$ in general formulae (C-I) and (C-II) respectively are preferably a hydrogen atom, a halogen atom, an alkoxy group, an aryloxy group, an acyloxy group, or a sulfonamido group.

$R_7$ and $R_9$ in general formula (M-I) are each an aryl group, and $R_8$ therein is a hydrogen atom, an aliphatic or aromatic acyl group, or an aliphatic or aromatic sulfonyl group. $Y_3$ represents a hydrogen atom or a leaving group. Suitable substituent groups for the aryl groups represented by $R_7$ and $R_9$ (preferably for the phenyl group) include the same groups which are suitable substituents for $R_1$. When the aryl group has two or more substituent groups, they may be the same or different. $R_8$ is preferably a hydrogen atom, or an aliphatic acyl or sulfonyl group, and particularly preferably a hydrogen atom. In particular, it is desirable that $Y_3$ should be a leaving group of the type which contains a sulfur, oxygen, or nitrogen atom at the leaving site, especially one which contains a sulfur atom at the leaving site, as disclosed in U.S. Pat. No. 4,351,897 and WO 88/04795.

In general formula (M-II), $R_{10}$ represents a hydrogen atom or a substituent group. $Y_4$ represents a hydrogen atom or a leaving group, and particularly preferably a halogen atom or an arylthio group. Za, Zb and Zc each represents an unsubstituted or substituted methine group, =N— or —NH—, provided that either the Za—Zb bond or the Zb—Zc bond is a double bond, and the remaining bond is a single bond. When the Zb—Zc bond is a C—C double bond, it may constitute a part of the aromatic ring. The compound represented by general formula (M-II) may form a dimer or a higher polymer via $R_{10}$ or $Y_4$, or a substituted methine group when Za, Zb or Zc represents a substituted methine group.

Among the pyrazoloazole type couplers represented by general formula (M-II), the imidazo[1,2-b]pyrazoles disclosed in U.S. Pat. No. 4,500,630 are preferred in view of the low yellow side absorption of the developed dyes and the light fastness thereof, and the pyrazolo[1-5b][1,2,4]triazoles disclosed in U.S. Pat. No. 4,540,654 are especially preferred.

In addition, preferred couplers include pyrazolotriazole couplers in which the 2-, 3- or 6-position of the pyrazolotriazole ring is substituted by a branched alkyl group, as disclosed in JP-A-61-65245; pyrazoloazole couplers which contain a sulfonamido group in the molecule, as disclosed in JP-A-61-65246; pyrazoloazole couplers which contain an alkoxyphenylsulfonamido group as a ballast group, as disclosed in JP-A-61-147254; and pyrazolotriazole couplers in which the 6-position is substituted by an alkoxy or aryloxy group, as disclosed, in European Patents (laid open) 226,849 and 294,785.

Specific examples of the couplers represented by the general formulae (C-I), (C-II), (M-I) and (M-II) respectively are illustrated below.

(C-1)
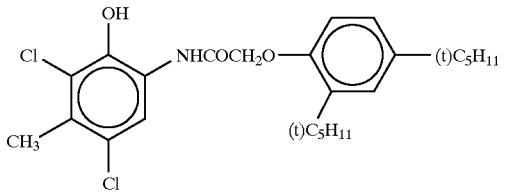
(C-2)
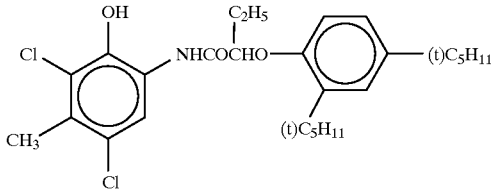
(C-3)
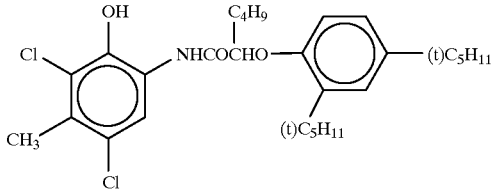
(C-4)
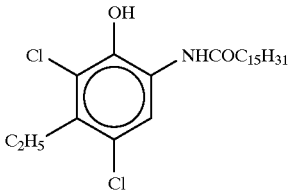
(C-5)
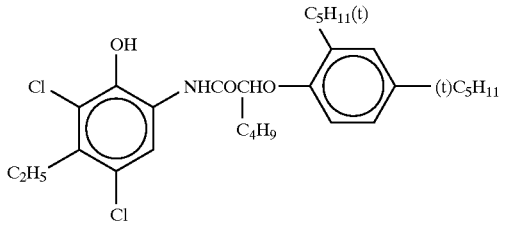
(C-6)
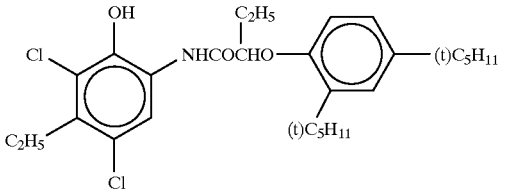
(C-7)
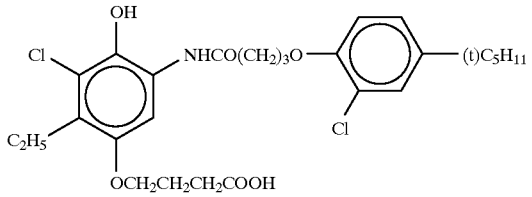
(C-8)
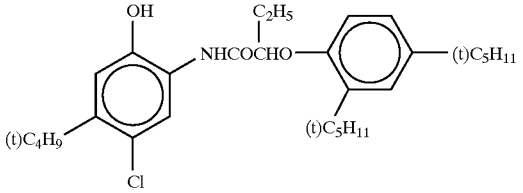
(C-9)
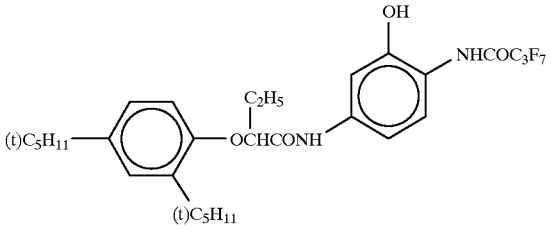
(C-10)
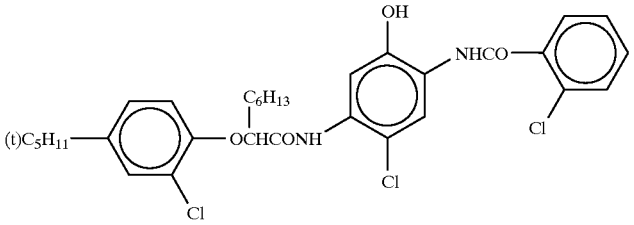

-continued
(C-11)
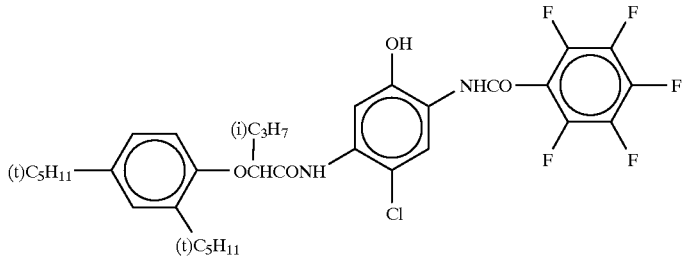
(C-12)
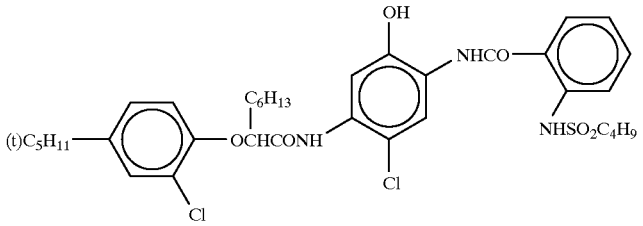
(C-13)
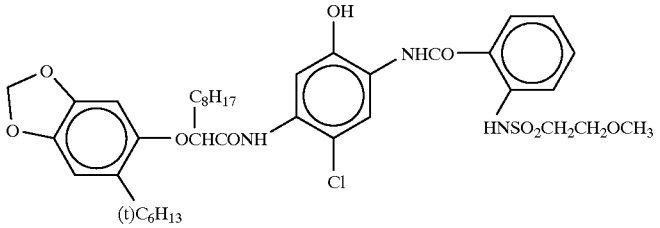
(C-14)
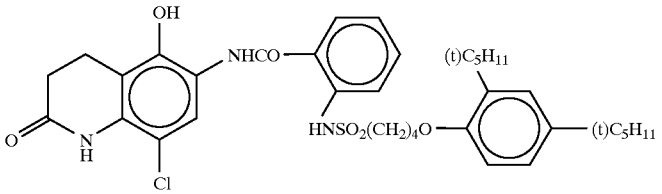
(C-15)
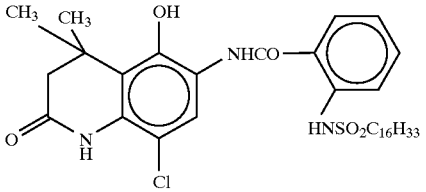
(C-16)
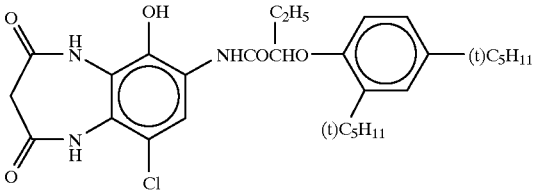
(C-17)
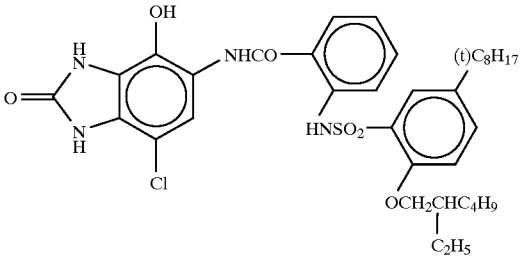
(C-18)
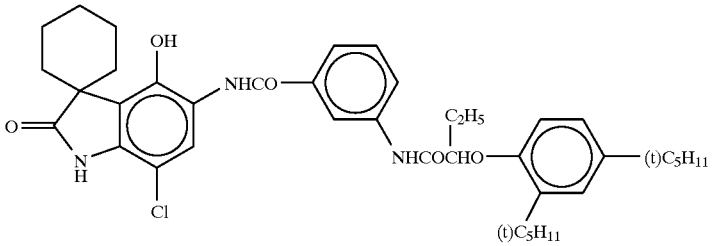

-continued
(C-19)
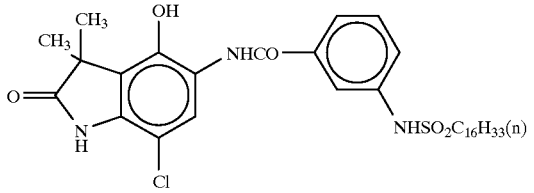
(C-20)
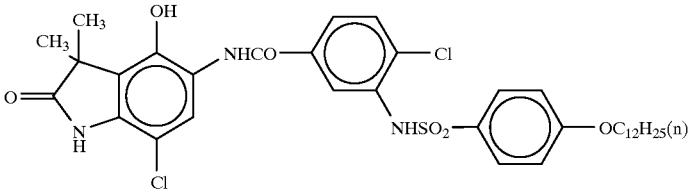
(C-21)
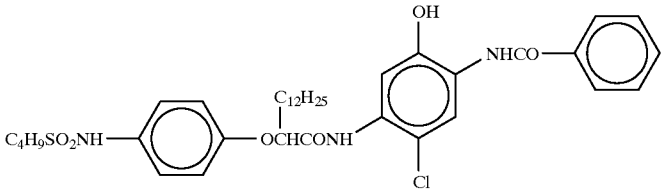
(C-22)
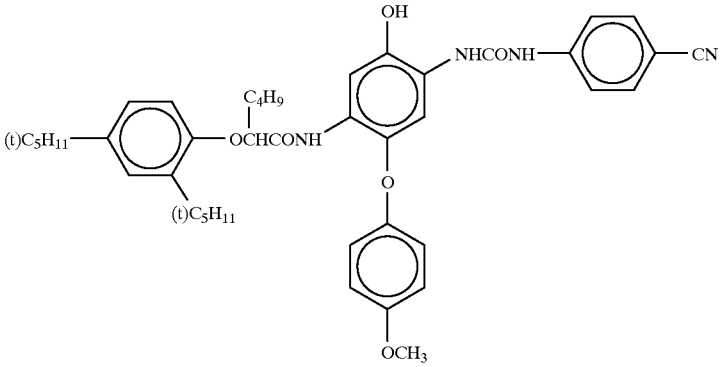
(M-1)
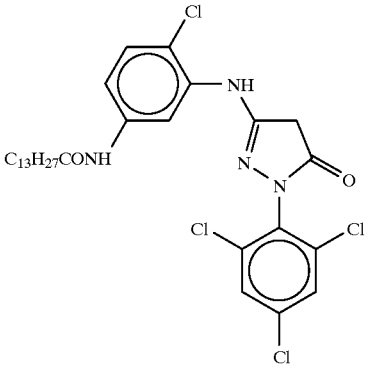
(M-2)
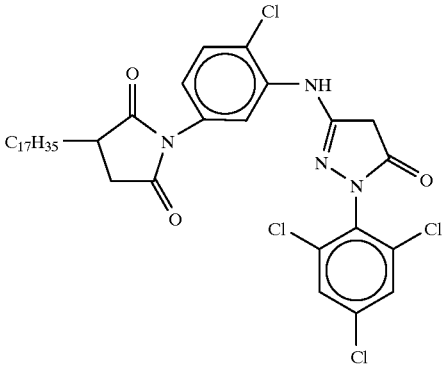

-continued
(M-3)
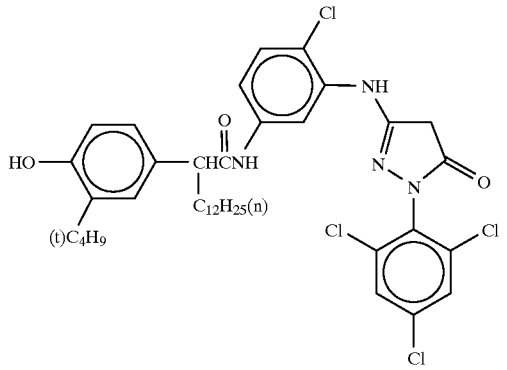
(M-4)
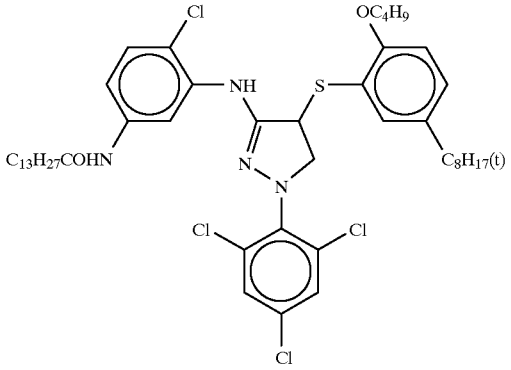
(M-5)
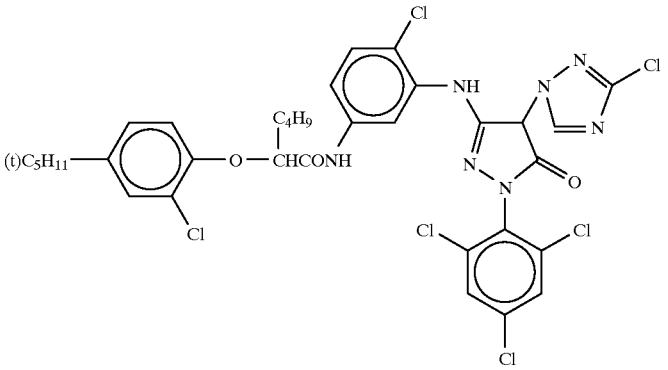
(M-6)
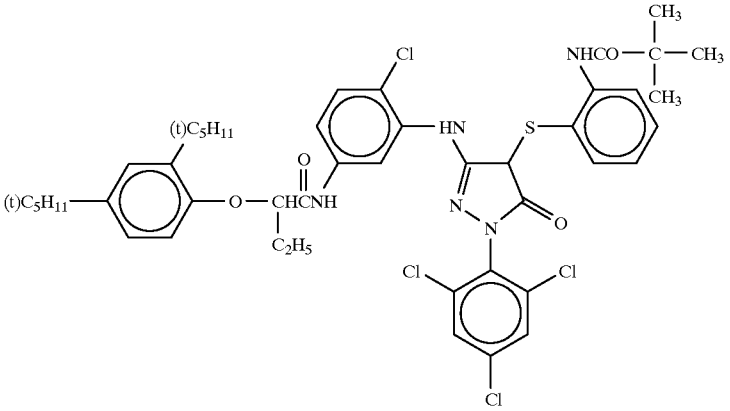
(M-7)
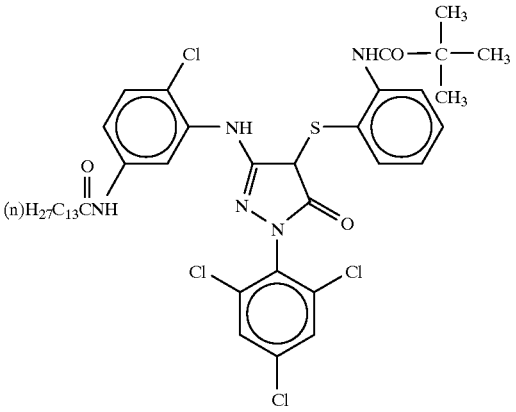

-continued
(M-8)
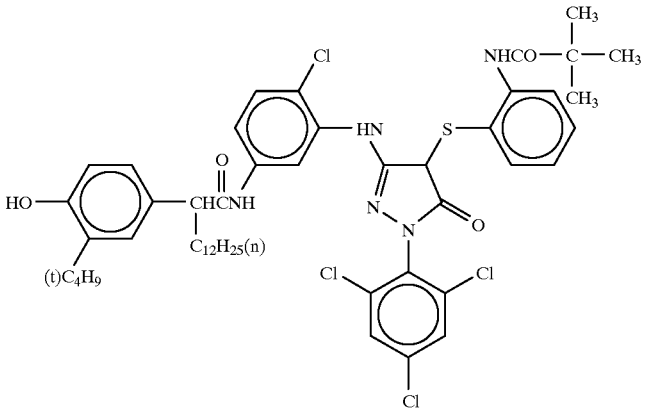

| Compound | $R_{10}$ | $R_{15}$ | $Y_4$ |
|---|---|---|---|
| | | 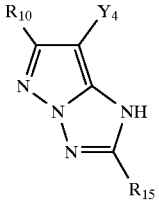 | |
| M-9 | $CH_3$— | 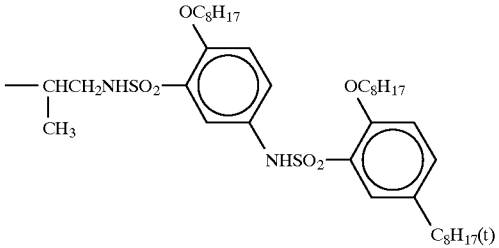 | Cl |
| M-10 | " | 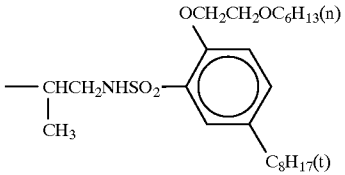 | " |
| M-11 | $(CH_3)_3C$— | 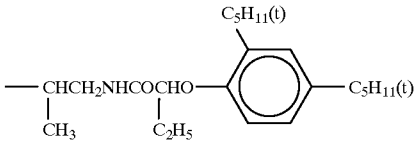 | 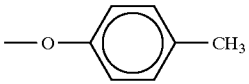 |

-continued
| Compound | $R_{10}$ | $R_{15}$ | $Y_4$ |
|---|---|---|---|
| M-12 | 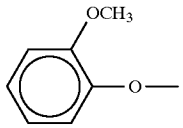 | 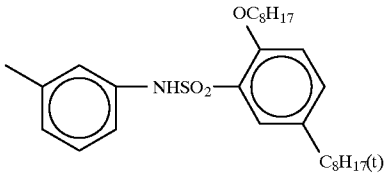 | 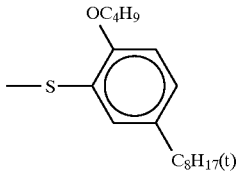 |
| M-13 | $CH_3$— | 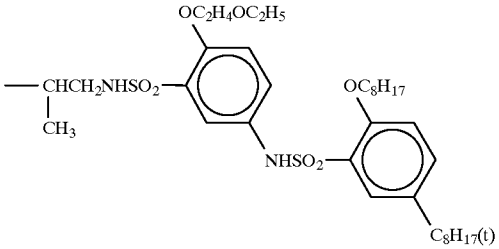 | Cl |
| M-14 | $CH_3$— | 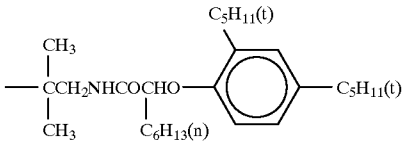 | Cl |
| M-15 | $CH_3$— | 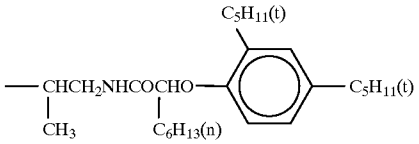 | Cl |
| M-16 | $CH_3$— | 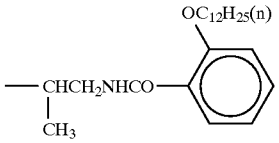 | Cl |

-continued
| Compound | $R_{10}$ | $R_{15}$ | $Y_4$ |
|---|---|---|---|
| M-17 | $CH_3$— | 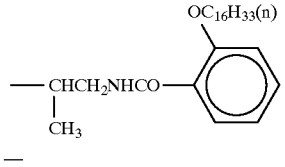 | Cl |
| M-18 | 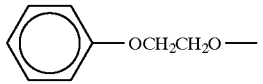 | 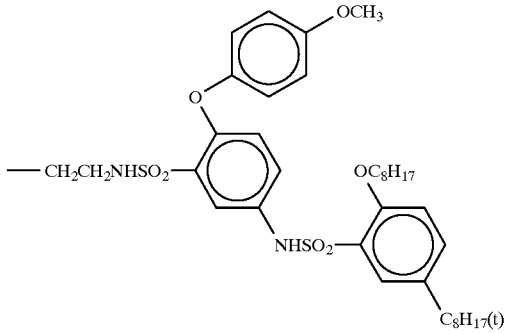 | 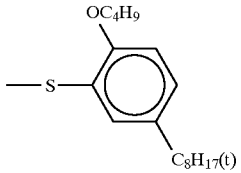 |
| M-19 | $CH_3CH_2O$— | " | " |
| M-20 | 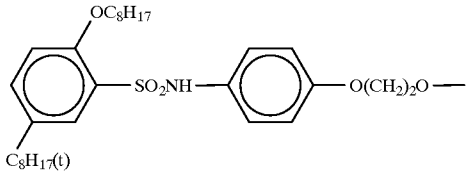 | 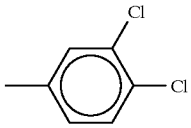 | 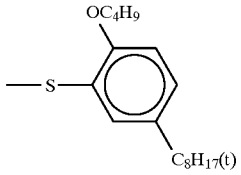 |
| M-21 | 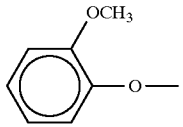 | 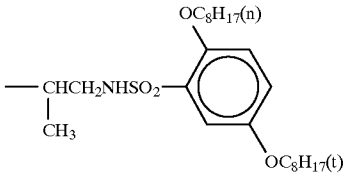 | Cl |

-continued
| Compound | $R_{10}$ | $R_{15}$ | $Y_4$ |
|---|---|---|---|
| | | 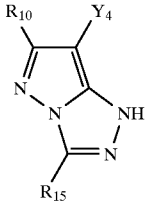 | |
| Compound | $R_{10}$ | $R_{15}$ | $Y_4$ |
|---|---|---|---|
| M-22 | $CH_3$— | 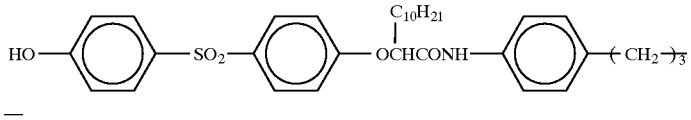 | Cl |
| M-23 | $CH_3$— | 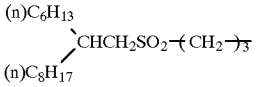 | Cl |
| M-24 | 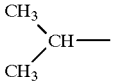 | 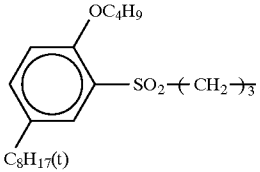 | Cl |
| M-25 | 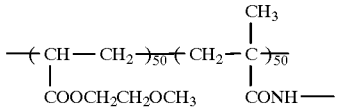 | 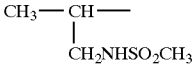 | Cl |
| M-26 | 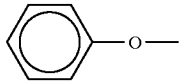 | 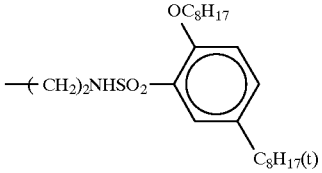 | Cl |

-continued
| Compound | $R_{10}$ | $R_{15}$ | $Y_4$ |
|---|---|---|---|
| M-27 | $CH_3$— | 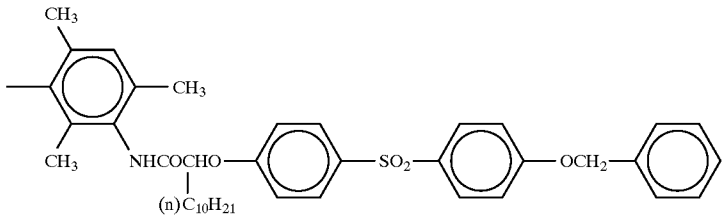 | Cl |
| M-28 | $(CH_3)_3C$— | 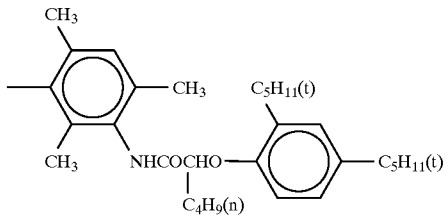 | Cl |
| M-29 | 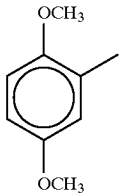 | 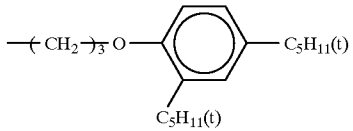 | Cl |
| M-30 | $CH_3$— | 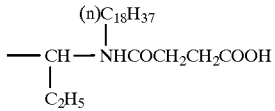 | Cl |

Each of the couplers represented by the foregoing general formulae (I), (C-I), (C-II), (M-I) and (M-II) is incorporated into a silver halide emulsion layer, which is a constituent of a light-sensitive layer, in an amount of generally from 0.1 to 1.0 mole, preferably from 0.1 to 0.5 mole, per mole of silver halide present therein.

In incorporating the above-described couplers into the light-sensitive layer, various known methods can be used. In general, the incorporation can be carried out using an oil-in-water dispersion method known as the oil-protect method, which comprises dissolving a coupler in solvents, and dispersing the dissolved coupler into a surfactant-containing aqueous gelatin solution in the form of an emulsion; or adding water or an aqueous gelatin solution to a surfactant-containing coupler solution, and causing phase inversion therein to make the mixture into an oil-in-water dispersion. In the case of alkali-soluble couplers, on the other hand, the so-called Fischer's dispersion method can be used. After the low boiling organic solvent is removed from the coupler dispersion by distillation, noodle washing, ultrafiltration or so on, the resulting dispersion may be mixed with a photographic emulsion.

As for the dispersion medium for couplers as cited above, high boiling organic solvents having a dielectric constant of from 2 to 20 (at 25° C.) and a refractive index of from 1.5 to 1.7 (at 25° C.) and/or water-insoluble high molecular weight compounds are used to advantage.

Preferred high boiling organic solvents include those represented by the following general formulae (A), (B), (C), (D) and (E), respectively.

(A)

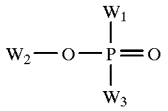

(B)

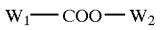

(C)

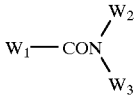

(D)

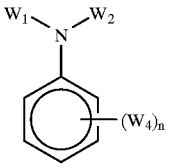

(E)

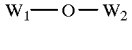

In the above formulae, $W_1$, $W_2$ and $W_3$ each represents a substituted or unsubstituted alkyl, cycloalkyl, alkenyl, aryl or heterocyclic group; $W_4$ represents $W_1$, —$OW_1$, or —$SW_1$; n represents an integer from 1 to 5, and when n is 2 or above the $W_4$ groups may be the same or different; and further, $W_1$ and $W_2$ in general formula (E) may combine with each other to form a condensed ring.

In addition to those compounds represented by general formulae (A) to (E), compounds which have a melting point of 100° C. or below and a boiling point of 140° C. or above, and which are immiscible with water can also be adopted as the high boiling organic solvent in this invention so far as they can function as good solvents for couplers. It is desirable that the high boiling organic solvents used in this invention have a melting point of 80° C. or below and a boiling point of 160° C. or above, particularly 170° C. or above.

These high boiling organic solvents are described in JP-A-62-215272, from the right lower column on page 137 to the right upper column on page 144.

Another method of incorporating these couplers into emulsion layers comprises impregnating a loadable latex polymer (as disclosed, e.g., in U.S. Pat. No. 4,203,716) with the couplers in the presence or the absence of such a high boiling organic solvent as described above, or dissolving the couplers in a polymer insoluble in water but soluble in an organic solvent, and then dispersing the resulting polymer into a hydrophilic colloid solution in an emulsified condition.

Preferred polymers for use in the above-described methods include the homo- or copolymers disclosed in WO 88/00723, from page 12 to page 30. In particular, acrylamide type polymers are favored over others in respect of stabilization of color images.

The light-sensitive material prepared in accordance with this invention may contain as color-fog inhibitors hydroquinone derivatives, aminophenol derivatives, gallic acid derivatives, ascorbic acid derivatives and the like.

In the light-sensitive material of this invention, various kinds of discoloration inhibitors can be used. Typical examples of organic discoloration inhibitors usable for cyan, magenta and/or yellow images include hindered phenols represented by hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ether or ester derivatives obtained by silylating or alkylating the phenolic OH groups contained in the above-cited compounds, respectively. In addition, metal complexes represented by (bissalicylaldoxmato)nickel complex and (bis-N,N-dialkyldithiocarbamato)nickel complexes can also be used for the above-described purpose.

Specific examples of organic discoloration inhibitors are described in the following patent specifications.

Hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. No. 4,360,589; p-alkoxyphenols are described, e.g., in U.S. Pat. No. 2,735,765, British Patent 2,066,975, JP-A-59-10539 and JP-B-57-19765 (the term "JP-B" as used herein means an "examined Japanese patent publication"); hindered phenols are described, e.g., in U.S. Pat. No. 3,700,455, JP-A-52-72224, U.S. Pat. No. 4,228,235, and JP-B-52-6623; gallic acid derivatives, methylenedioxybenzenes and aminophenols are described, e.g., in U.S. Pat. No. 3,457,079, U.S. Pat. No. 4,332,886 and JP-B-56-21144, respectively; hindered amines are described, e.g., in U.S. Pat. Nos. 3,336,135 and 4, 268,593, British Patents 1,326,889, 1,354,313 and 1,410, 846, JP-B-51-1420, JP-A-58-114036, JP-A-59-53846 and JP-A-59-78344; and metal complexes are described, e.g., in U.S. Pat. Nos. 4,050,938 and 4,241,155, and British Patent 2,027,731 (A). These compounds can accomplish their purpose when used in a proportion of, in general, from 5 to 100 wt % of the couplers contained in the same layer as that containing an organic discoloration inhibitor, respectively, and emulsified together therewith, followed by incorporation into light-sensitive layers. In order. to prevent cyan dye images from deteriorating due to heat, and light in particular, it is more effective to introduce an ultraviolet absorbent into the cyan color-forming layer and both layers adjacent thereto.

As examples of ultraviolet absorbents usable for the above-described purpose, mention may be made of aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., U.S. Pat. Nos. 3,705,805 and 3,707,395), butadiene compounds (as disclosed, e.g., in U.S. Pat. No. 4,045,229), and benzoxidol compounds (as disclosed, e.g., in U.S. Pat. Nos. 3,406,070, 3,677,672 and 4,271,307. Also, ultraviolet-absorbing couplers (e.g., α-naphthol type cyan dye-forming couplers) and ultraviolet-absorbing polymers may be employed. These ultraviolet absorbents may be mordanted to be fixed to a particular layer.

Among these ultraviolet absorbents, the foregoing aryl-substituted benzotriazole compounds are preferred.

In particular, it is desirable that the compounds described below be used together with the foregoing couplers, especially pyrazoloazole type couplers.

That is, compounds of the kind which can produce chemically inert, substantially colorless compounds by combining chemically with an aromatic amine developing agent remaining after the color development-processing (Compounds F) and/or compounds of the kind which can produce chemically inert, substantially colorless compounds by combining chemically with an oxidized product of an aromatic amine developing agent remaining after the color development-processing (Compounds G) are used individually or in combination to effectively prevent the generation of stains upon storage after photographic processing, which is due to formation of dyes through the reaction between couplers and an unoxidized color developing agent or an oxidized product of a color developing agent remaining in the photographic film after the photographic processing, and the occurrence of other side reactions.

Compounds which are preferred as Compound F are compounds capable of reacting with p-anisidine wherein the kinetic constant of the second order reaction, $k_2$ (in 80° C. trioctyl phosphate) ranges from 1.0 l/mol·sec to $1\times10^{-5}$/mol·sec. The measurement of the kinetic constant of the second order reaction can be performed according to the method described in JP-A-63-158545.

When $k_2$ is greater than the upper limit of the foregoing range, the compound itself becomes unstable, so it sometimes happens that the compound decomposes through a reaction with gelatin or water. On the other hand, when $k_2$ is smaller than the lower limit of the foregoing range, the reaction with the residual aromatic amine developing agent becomes slow, so it is often impossible to prevent undesirable side effects of the residual aromatic amine developing agent.

Among the Compounds (F), preferred compounds can be represented by the following general formulae (FI) and (FII):

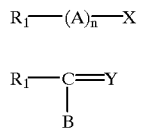

(FI)

(FII)

In the above formulae, $R_1$ and $R_2$ each represents an aliphatic, aromatic or heterocyclic group; n represents 1 or 0; A represents a group capable of forming a chemical bond by a reaction with an aromatic amine developing agent; B represents a hydrogen atom, an aliphatic group, an aromatic group, a heterocyclic group, an acyl group, or a sulfonyl group; and Y represents a group capable of accelerating the addition of an aromatic amine developing agent to the compound of general formula (FII). Further, $R_1$ and X in formula (FI), and Y and $R_2$ or B in formula (FII) may combine with each other to complete a cyclic structure.

The typical representative ways in which the foregoing compounds combine chemically with residual aromatic amine developing agents are substitution and addition.

Specific examples of the compounds represented by general formulae (FI) and (FII) respectively include those disclosed in JP-A-63-158545, JP-A-62-283338, European Patents (laid-open) 298321 and 277589, and so on.

On the other hand, those compounds which are preferred as Compound (G), and which can combine chemically with an oxidized product of an aromatic amine developing agent remaining after color development to produce a chemically inert, colorless compound, can be represented by the following general formula (GI):

R—Z (GI)

wherein R represents an aliphatic group, an aromatic group, or a heterocyclyl group; and Z represents a nucleophilic group, or a group capable of releasing a nucleophilic group through decomposition in the light-sensitive material. In the compounds represented by general formula (GI), it is desirable that Z should be a group having a Pearson's nucleophilic "$CH_3I$" value of 5 or more, or a group derived therefrom. See R. G. Pearson et al., 90 *J. Am. Chem. Soc.* 319 (1968).

Examples of particularly preferred compounds among those represented by general formula (GI) include the compounds disclosed in European Patent (laid-open) 255,722, JP-A-62-143048, JP-A-62-229145, Japanese Patent Application Nos. 63-136724 and 62-214681, European Patents (laid-open) 298321 and 277589, and so on.

In addition, details of the combination of the foregoing Compounds (G) with the foregoing Compounds (F) are disclosed in European Patent (laid-open) 277589.

The light-sensitive material prepared in accordance with this invention may contain in hydrophilic colloid layers as a filter dye, or for various purposes, e.g., prevention of irradiation and halation, a water-soluble dye or a dye that becomes soluble in water as a result of photographic processing. Examples of dyes suitable for such purposes include oxonol dyes, hemioxonol dyes, styryl dyes, merocyanine dyes, cyanine dyes, and azo dyes. Among these dyes, oxonol dyes, hemioxonol dyes and merocyanine dyes are particularly preferred.

Gelatin is preferred as the binder or the protective colloid for the emulsion layers constituting the light-sensitive material of this invention. Of course, other hydrophilic colloids can be employed independently, or together with gelatin.

Gelatin which can be used in this invention includes not only lime-processed gelatin, but also acidprocessed gelatin. Details of methods for preparing gelatins are described in Arthur Weiss, *The Macromolecular Chemistry of Gelatin*, Academic Press (1964).

The term "reflex support" as used herein describes supporting materials whose reflectivities are enhanced to impart sharpness to dye images formed in silver halide emulsion layers, and includes supporting materials coated with hydrophobic resin in which a light-reflecting substance, such as titanium oxide, zinc oxide, calcium carbonate, calcium sulfate or the like, is dispersed; and hydrophobic resin films in which a light-reflecting substance is dispersed. Specific examples of such reflex supports include baryta paper, polyethylene-coated paper, polypropylene paper, and transparent supports provided with reflecting layer(s) or those containing reflecting substance(s) therein. Examples of usable transparent supports include glass plate, films of polyesters such as polyethylene terephthalate, cellulose triacetate, cellulose nitrate, etc., polyamide films, polycarbonate films, polystyrene films, vinyl chloride resin films, and so on.

As other reflex supports, those having specular reflectivity or metallic surfaces of the second kind diffuse reflectivity can be used. Metallic surfaces having spectral reflectances of 0.5 or above in the visible wavelength region are preferred. In addition, it is desirable that the metallic surfaces be roughened or acquire a diffuse reflectivity with metal powder. Suitable examples of metals which can be used include aluminum, tin, silver, magnesium, and alloys thereof. The surface of the reflex support may be a metal plate, a metal foil or a thin metal layer formed using a rolling technique, an evaporation technique, a metal plating technique or so on. In particular, it is preferred to form the metal surface by evaporating a thin metal layer onto a substrate of another kind. Further, it is desirable that the metal surface be provided with a water-proof resin layer, preferably a thermoplastic resin layer. In addition, it is desirable that the support for the metal surface be provided with an antistatic layer on the side opposite to the metal surface. Details of supports of the above-described kinds are described, e.g., in JP-A-61-210346, JP-A-63-24247, JP-A-63-24251 and JP-A-63-24255.

The support which can properly be used in this invention is selected from among the above-described supports depending on the end-use purpose of the light-sensitive material of the invention.

As the light reflecting substances, white pigments which have been thoroughly kneaded in the presence of a surfactant, and those which have undergone a surface treatment with a di- to tetrahydric alcohol are preferably used.

As for the proportion (%) of area occupied by the fine grains of white pigment per unit area, the most typical method of determining this proportion comprises subdividing an observed area into adjacent unit areas measuring 6 $\mu$m by 6 $\mu$m, and measuring the proportion of the area occupied by the projected fine grains in each unit area (represented by Ri %). The variation coefficient of the proportion of the occupied area can be determined as the ratio of the standard deviation of Ri (represented by s) to the mean of Ri (represented by $\overline{R}$), that is, $s/\overline{R}$. The number of unit areas to be examined as subjects is preferably at least 6.

The variation coefficient, $s/\overline{R}$, can be determined according to the following formula:

$$s/\overline{R} = \sqrt{\frac{\sum_{i=1}^{n}(Ri-\overline{R})^2}{n-1}} \Big/ \frac{\sum_{i=1}^{n} Ri}{n}$$

It is desirable in this invention that the coefficient of variation in the proportion (%) of the area occupied by the fine grains of pigment should be 0.15 or less, preferably 0.12 or less. When the coefficient is below 0.08 or less, the condition of the dispersed grains can be referred to as "substantially uniform".

The color photographic light-sensitive material of this invention is preferably subjected to color development, bleach-fix, and washing or stabilization processing. However, bleach and fixation processing need not be carried out with a monobath, but may be carried out separately.

The color developing solution to be used for the development-processing of the light-sensitive material of this invention is preferably an alkaline aqueous solution containing as a main component an aromatic primary amine type color developing agent. Preferred color developing agents are p-phenylenediamine compounds, though aminophenol compounds are also useful. Typical representatives of p-phenylenediamine compounds include 3-methyl-4-amino-N,N-diethylaniline, 3-methyl-4-amino-N-ethyl-N-β-hydroxyethylaniline, 3-methyl-4-amino-B-ethyl-N-β-methanesulfonamidoethylaniline, 3-methyl-4-amino-N-ethyl-N-β-methoxyethylaniline, and sulfates, hydrochlorides or p-toluenesulfonates of the above-cited anilines.

In general, the color developing solution contains pH buffering agents such as carbonates or phosphates of alkali metals, and development inhibitors or antifoggants such as bromides, iodides, benzimidazoles, benzothiazoles or mercapto compounds. In addition, the solution can optionally contain various kinds of preservatives, e.g., hydroxylamine, diethylhydroxylamine, sulfites, hydrazines such as N,N-biscarboxymethylhydrazine, phenylsemicarbazides, triethanolamine, catechol sulfonic acids, and so on; organic solvents such as ethylene glycol, diethylene glycol, etc.; development accelerators such as benzyl alcohol, polyethylene glycol, quaternary ammonium salts, amines, etc.; dye forming couplers; competing couplers; auxiliary developers such as 1-phenyl-3-pyrazolidone, etc.; viscosity imparting agents; and various chelating agents represented by aminopolycarboxylic acid, aminopolyphosphonic acid, alkylphosphonic acid, phosphonocarboxylic acid, e.g., by ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts of the above-cited acids.

In cases where a reversal processing is carried out, a black-and-white development and the reversal processing are performed prior to color development. In the black-and-white developing solution, known black-and-white developing agents, such as 3-pyrazolidones including 1-phenyl-3-pyrazolidone, or aminophenols including N-methyl-p-aminophenol, can be used individually or in combination.

The pH of these color and black-and-white developing solutions generally ranges from 9 to 12. The amount of replenisher used with these developing solutions, though it depends on the kind of color photographic light-sensitive materials to be processed, is generally 3 l or less per $m^2$ of the light-sensitive material processed. Also, it is feasible to reduce the amount of the replenisher to 500 ml/$m^2$ or less by lowering the bromide ion concentration in the replenisher. When a replenisher is used in a reduced amount, it is desirable that evaporation and aerial oxidation of the developing solution be prevented by reducing the contact area between the air and the developing solution in the processing tank. The contact area between the air and the photographic processing solution in the processing tank can be represented by the opening ratio defined as follows:

| | |
|---|---|
| Opening ratio = | Area of processing solution in contact with air ($cm^2$)/volume of processing solution ($cm^3$) |

The opening ratio described above is preferably controlled to 0.1 or less, more preferably from 0.001 to 0.05.

A shield, such as a floating cover, may be placed on the surface of the processing solution in the processing tank to lower the opening ratio. Other methods of lowering the opening ratio include using a mobile cover as disclosed in Japanese Patent Application No. 62-241342, and using the slit development processing method disclosed in JP-A-63-216050.

It is desirable that the opening ratio be reduced at every step of the process, including not only the color and black-and-white development steps, but also subsequent stpes, such as bleaching, bleach-fixing, fixing, washing and stabilization.

Also, the amount of replenisher can be reduced by measures which inhibit the accumulation of bromide ion in the developing solution. The processing time for color development is generally within the range of 2 to 5 minutes, but can be shortened by carrying out processing under high temperature and high pH, and by using a highly concentrated developing agent.

Photographic emulsion layers are generally subjected to bleach processing after color development. The bleach processing may be carried out simultaneously with a fixation processing (blix processing), or separately. To further increase the processing speed, a blix processing may be carried out after the bleach processing. Also, processing may be carried out with two successive bleach-fix baths, or fixation processing may be carried out before blix processing, or bleach processing may be carried out after blix processing. That is, any manner may be employed in desilvering, if desired. Examples of bleaching agents which can be used include compounds of polyvalent metals such as Fe(III) or the like. Representatives of such compounds are Fe(III) complex salts of organic acids, for example, aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, etc.; citric acid, tartaric acid, malic acid, and so on. Among these bleaching agents, (aminopolycarbonato)iron(III) complex salts, such as (ethylenediaminetetraacetonato)iron(III) complex salts, are particularly preferred for rapid processing and prevention of environmental pollution. In addition, (aminopolycarbonato) iron(III) complex salts are especially useful in both bleaching and bleach-fix baths. A bleaching or bleach-fix bath utilizing an (aminopolycarbonato)iron(III) complex salt as cited above is generally adjusted to a pH range of 4.0–8.0. For the purpose of speeding up the processing, the processing may be carried out under a pH lower than the above-described range.

In the bleaching bath, the bleach-fix bath and/or the pre-bath thereof, a bleach accelerator can be used, if needed. Specific examples of useful bleach accelerators include mercapto group- or disulfido linkage-containing compounds as disclosed in U.S. Pat. No. 3,893,858, West German Patent 1,290,812, JP-A-53-95630, and *Research Disclosure*, No. 17129 (July, 1978); thiazolidine derivatives disclosed in JP-A-50-140129; thiourea derivatives disclosed in U.S. Pat. No. 3,706,561; iodides disclosed in JP-A-58-16235; polyoxyethylene compounds disclosed in West German Patent 2,748,430; polyamine compounds disclosed in JP-B-45-8836; and bromide ion. Among these compounds, compounds containing a mercapto group or a disulfido linkage are preferred because of their great effects upon bleach acceleration. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. Bleach accelerators as cited above may be incorporated in photosensitive materials. In bleach-fixing of color photosensitive materials for photograph-taking use, such bleach accelerators are especially effective.

Examples of fixers which can be used include thiosulfates, thiocyanates, thioether compounds, thioureas, and a large quantity of iodide. In general, thiosulfates are used as fixers. In particular, ammonium thiosulfate can be used in the widest range. Preferred preservatives for the bleach-fix bath are sulfites, bisulfites, sulfinic acids such as p-toluenesulfinic acid, and carbonyl-bisulfite adducts.

After desilvering, the silver halide color photographic material is, in general, subjected to a washing and/or stabilization processing. The volume of washing water required in the washing can be adjusted depending on the characteristics of the light-sensitive materials to be processed (e.g., on what kinds of couplers are incorporated therein), the end-use purposes of the light-sensitive materials, the temperature of the washing water, the number of washing tanks (the number of stages), the manner of replenishing the washing water (e.g., whether the water flows in a counter-direction, or a different direction, such as a co-current direction), and various other conditions. The relation between the number of washing tanks and the volume of washing water in a multistage counter-current process can be determined according to the methods described in the *Journal of the Society of Motion Picture and Television Engineers*, volume 64, pages 248–253 (May 1955).

According to the multistage counter-current process, the volume of washing water can be sharply decreased. However, the process has a disadvantage, in that bacteria which have propagated themselves in the tanks because of the increase in the residence time of the water in the tanks produce suspended matter, and the resulting suspended matter sticks to light-sensitive materials processed therein. The means of solving this problem by lowering the calcium and magnesium ion concentrations, as disclosed in JP-A-62-288838, can be employed to great advantage. A further means of solving the problem is to use bactericides such as the isothiazolone compounds and the thiabendazole compounds disclosed in JP-A-57-8542; the chlorine-containing germicides such -as the sodium salt of chlorinated isocyanuric acid; or other germicides such as benzotriazoles, as described in Hiroshi Horiguchi, *Bohkin Bohbai no Kagaku* ("Antibacterial and Moldproof Chemistry"), Sankyo Shuppan (1986); *Biseibutsu no Mekkin Sakkin Bohbai Gijutsu* ("Arts of Sterilizing and Pasteurizing Microbes, and Proofing Against Molds"), compiled by Eisei Gijutsukai, published by Kogyo Gijutsu Kai in 1982; and *Bohkin-Bohbaizai*

*Jiten* ("Thesaurus of Antibacterial Agents and Antimolds"), compiled by Nippon Bohkin Bohbai Gakkai.

Suitable pH's for the washing water in processing the photosensitive material of this invention is from 4 to 9, more preferably from 5 to 8. The washing temperature and time, though they can be adjusted depending on the characteristics and the intended use of the photosensitive materials, are within from 20 seconds to 10 minutes at temperatures from 15° C. to 45° C., preferably, 30 seconds to 5 minutes at temperatures from 25° C. to 40° C.

Also, the photosensitive material of this invention can be processed directly with a stabilizer instead of undergoing the above-described washing processing. To such a stabilization processing, all of known methods as disclosed in JP-A-57-8543, JP-A-58-14834 and JP-A-60-220345 can be applied.

On the other hand, stabilization processing may be carried out subsequent to the above-described washing processing. For example, various kinds of chelating agents and antimolds can be added to a stabilizing bath containing formaldehyde and a surfactant which is used as the final processing bath for color photosensitive materials for photograph-taking use.

The solution overflowing the washing bath and/or the stabilizing bath can be reused in another processing step, such as a desilvering step.

A color developing agent may be incorporated in the silver halide color photographic material of this invention with the intention of simplifying and speeding up processing. In incorporating the color developing agent, it is desirable that it is used in the form of precursor. Examples of such precursors include the indoaniline compounds disclosed in U.S. Pat. No. 3,342,597, the compounds of Schiff base type disclosed in U.S. Pat. No. 3,342,599, *Research Disclosure*, No. 14850, and ibid. No. 15159, the aldol compounds disclosed in Research Disclosure No. 13924, the metal complexes disclosed in U.S. Pat. No. 3,719,492, and the urethane compounds disclosed in JP-A-53-135628.

Various kinds of 1-phenyl-3-pyrazolidones may be incorporated in the silver halide color photographic material of this invention for the purpose of accelerating color development, if needed. Typical examples of such pyrazolidones are disclosed in JP-A-56-64339, JP-A-57-144547 and JP-A-58-115438.

The temperature for various processing solutions used in connection with this invention is 10°–50° C. Though the standard temperature is generally from 33° C. to 38° C., temperatures higher than this range can be chosen to reduce the processing time by accelerating the processing, or lower temperatures can be chosen to achieve improved image quality and to enhance the stability of the processing bath.

Moreover, a processing with a cobalt or hydrogen peroxide intensifier as disclosed in West German Patent 2,226,770 or U.S. Pat. No. 3,675,499, respectively, may be carried out for the purpose of saving silver in the photosensitive material.

The present invention is described below by reference to the following illustrative examples, but the invention is not to be construed as being limited by these examples.

EXAMPLE 1

On a paper support laminated with polyethylene on both sides the layers described below were coated in the order described to produce a multilayer color photographic paper. The coating solutions employed were prepared as follows.

Preparation of Coating Solution for First Layer:

A mixture of 19.1 g of a yellow coupler (ExY), 4.4 g of a color image stabilizer (Cpd-1) and 0.7 g of a color image stabilizer (Cpd-7) was dissolved in a mixed solvent consisting of 27.2 ml of ethyl acetate and 8.2 g of a high boiling solvent (Solv-1), and then dispersed in an emulsified condition into 185 ml of a 10% aqueous gelatin solution containing 8 ml of a 10% solution of sodium dodecylbenzene sulfonate to obtain an emulsified dispersion.

On the other hand, two kinds of silver chlorobromide emulsions (both of which had a cubic crystal form; one of which had an average grain size of 0.88 $\mu$m and a variation coefficient of 0.08 with respect to the grain size distribution, and the other of which had an average grain size of 0.70 $\mu$m and a variation coefficient of 0.10 with respect to the grain size distribution; both of which contained 0.2 mol % of silver bromide localized at part of the grain surface) were prepared. Each of the blue-sensitive sensitizing dyes illustrated below were added to the large grain size emulsion in the amount of $2.0\times10^{-4}$ mole per mole silver, and to the small grain size emulsion in the amount of $2.5\times10^{-4}$ mole per mole of silver, and then the emulsions were subjected to sulfur sensitization. The resulting emulsions were mixed together in a ratio (the former emulsion to the latter one) of 3:7 by mole (based on silver). These emulsions were prepared in accordance with the method disclosed in European Patent EP0273430. In addition, the presence of a silver bromide-localized phase was confirmed by the method of the above-cited European patent. The thus obtained emulsion mixture was mixed and homogenized with the foregoing emulsified dispersion, and thereto were added the other ingredients described below to obtain the coating solution for the first layer having the composition described below.

The coating solutions for the second to seventh layers were prepared respectively in a similar manner as that for the first layer. In each layer, the sodium salt of 1-oxy-3,5-dichloro-s-triazine was used as a gelatin hardener.

The dyes used in each layer as both spectral sensitizing dyes and as CR compounds effective in the formation of a .silver bromide-localized phase are illustrated below.

Blue-sensitive Emulsion Layer:

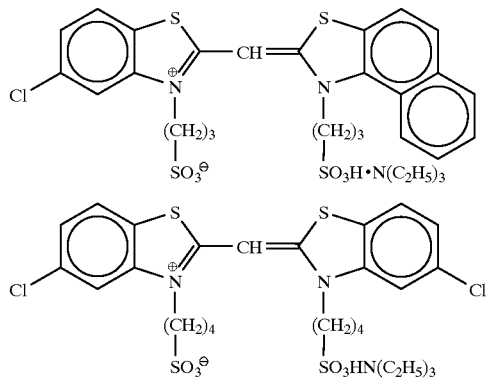

(which were both added to the large grain size emulsion in the amount of $2.0\times10^{-4}$ mol/mol silver halide, and to the small grain size emulsion in the amount of $2.5\times10^{-4}$ mol/mol silver halide);

Green-sensitive Emulsion Layer:

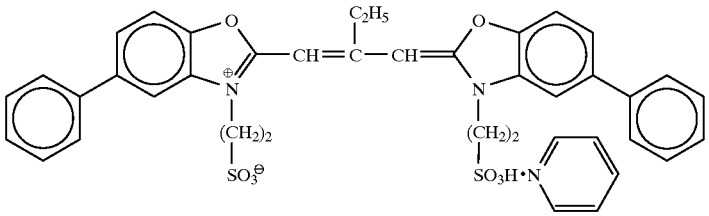

(which was added to the large grain size emulsion in the amount of $4.0\times10^{-4}$ mol/mol silver halide, and to the small grain size emulsion in the amount of $5.6\times10^{-4}$ mol/mol silver halide); and

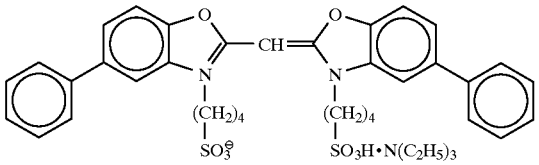

(which was added to the large grain size emulsion in the amount of $7.0\times10^{-5}$ mol/mol silver halide, and to the small grain size emulsion in the amount of $1.0\times10^{-5}$ mol/mol silver halide);

Red-sensitive Emulsion Layer:

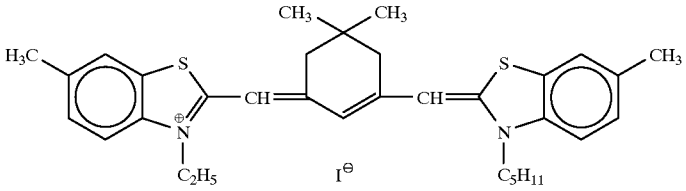

(which was added to the large grain size emulsion in the amount of $0.9\times10^{-4}$ mol/mol silver halide, and to the small grain size emulsion in the amount of $1.1\times10^{-4}$ mol/mol silver halide).

The following compound was added to the red-sensitive emulsion layer in the amount of $2.6\times10^{-3}$ mole per mole of silver halide:

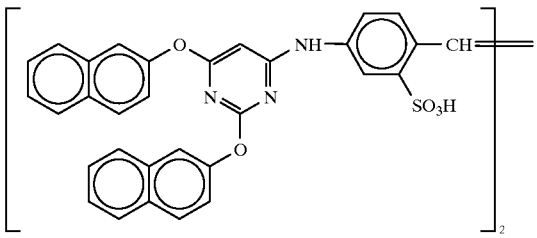

In addition, 1-(5-methylureidophenyl)-5-mercaptotetrazole was added to the blue-sensitive emulsion layer, the green-sensitive emulsion layer and the red-sensitive emulsion layer in the amount of $8.5\times10^{-5}$ mole, $7.7\times10^{-4}$ mole and $2.5\times10^{-4}$ mole, respectively, per mole of silver halide.

Moreover, the dyes illustrated below were added to the emulsions to prevent the resulting photographic material from irradiation:

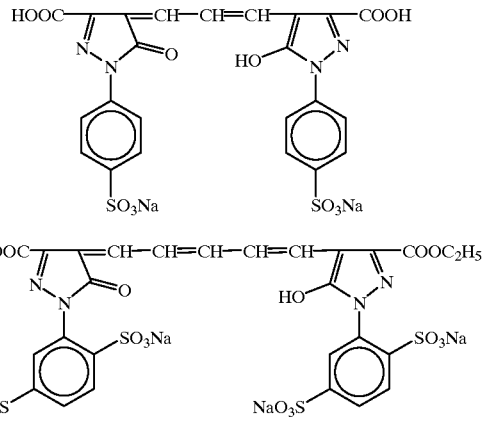

and

-continued

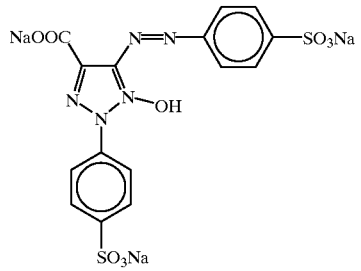

Then, the composition of each constituent layer was as described below. Each figure on the right side represents a coverage ($g/m^2$) of the corresponding ingredient. As for the silver halide emulsion, the figure represents the coverage based on silver. Support:

Polyethylene-laminated paper [which contained white pigment ($TiO_2$) and a bluish dye (ultra-marine) in the polyethylene on the side of the first layer]

| | |
|---|---|
| First layer (blue-sensitive layer): | |
| Silver chlorobromide emulsion described above | 0.30 |
| Second layer (color stain inhibiting layer): | |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Gelatin | 0.99 |
| Color stain inhibitor (Cpd-5) | 0.08 |
| Solvent (Solv-1) | 0.16 |
| Solvent (Solv-4) | 0.08 |
| Third Layer (green-sensitive layer): | |
| Silver chlorobromide emulsion (having a cubic crystal form, and being a 1:3 mixture (wt % in terms | 0.12 |

-continued

| | |
|---|---|
| of silver) of an emulsion having an average grain size of 0.55 μm and a variation coefficient of 0.10 with respect to grain size distribution with an emulsion having an average grain size of 0.39 μm and variation coefficient of 0.08 with respect to grain size distribution, which each contained 0.8 mol % of AgBr localized at part of the grain surface) | |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |

-continued

| | |
|---|---|
| Fourth layer (ultraviolet absorbing layer): | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth layer (red-sensitive layer): | |
| Silver chlorobromide emulsion (having a cubic crystal form, and being a 1:4 mixture (wt % in terms of silver) of an emulsion having an average grain size of 0.58 μm and a variation coefficient of 0.09 with respect to grain size distribution with an emulsion having an average grain size of 0.45 μm and a variation coefficient of 0.11 with respect to grain size distribution, which each contained 0.6 mol % of AgBr localized at part of the grain surface) | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth layer (ultraviolet absorbing layer): | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Seventh layer (protective layer): | |
| Gelatin | 1.33 |
| Acryl-modified polyvinyl alcohol (modification degree: 17%) | 0.17 |
| Liquid paraffin | 0.03 |

(ExY) Yellow Coupler

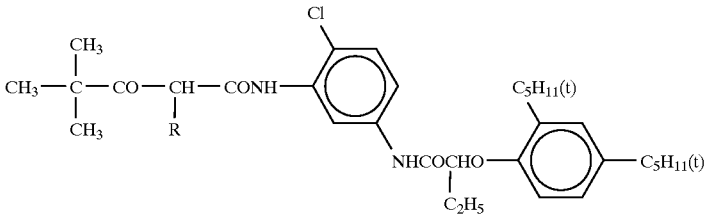

1:1 (by mole) mixture of that of R =

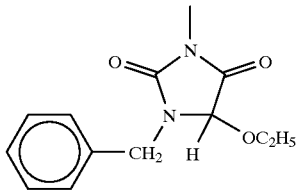

-continued
with that of R =
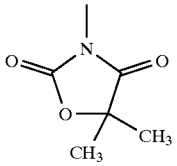
(ExM) Magenta Coupler
1:1 (by mole) mixture of
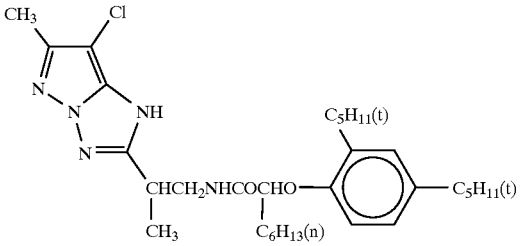
with
-continued
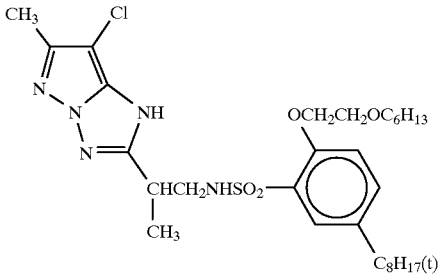
(ExC) Cyan Coupler
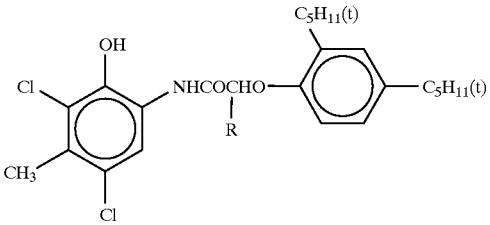
2:4:4 mixture of that of R═$C_2H_5$, that of R═$C_4H_9$ and
that of R =
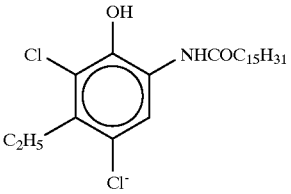
(Cpd-1) Color Image Stabilizer
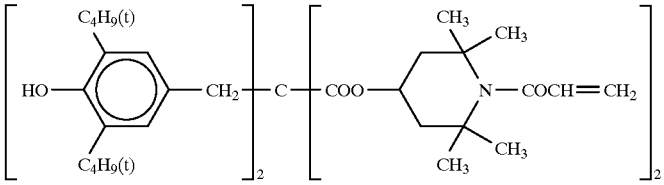
(Cpd-2) Color Image Stabilizer
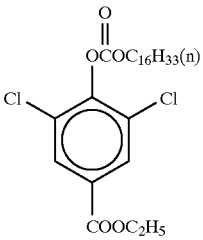

-continued
(Cpd-3) Color Image Stabilizer
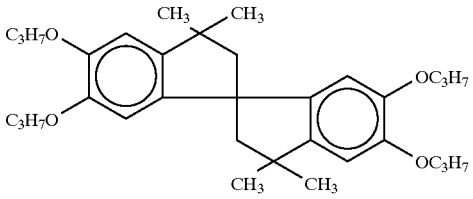
(Cpd-4) Color Image Stabilizer
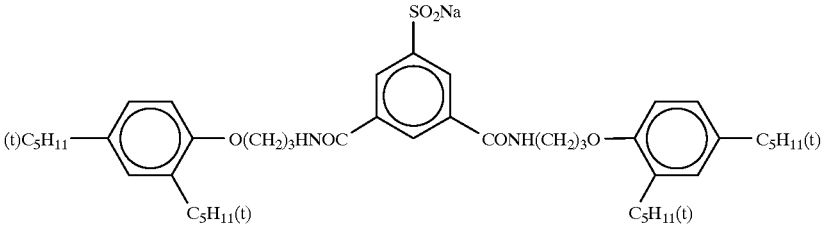
(Cpd-5) Color Mixing Inhibitor
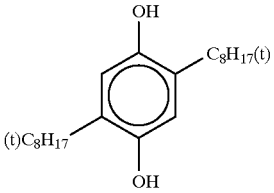
(Cpd-6) Color Image Stabilizer
2:4:4 mixture (by weight) of
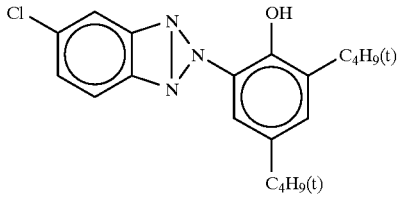
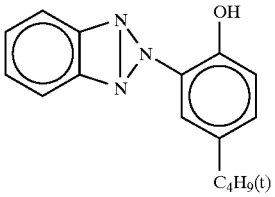
and
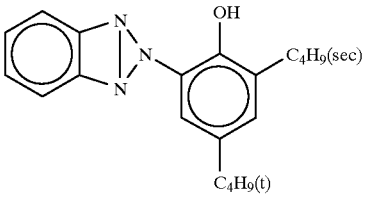
(Cpd-7) Color Image Stabilizer
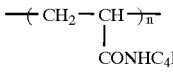
Mean molecular weight 60,000

-continued
(Cpd-8) Color Image Stabilizer
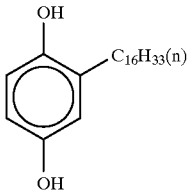
(Cpd-9) Color Image Stabilizer
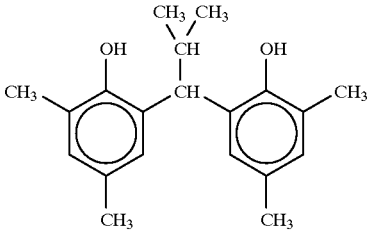
(UV-1) Ultraviolet Absorbent
4:2:4 (by weight) mixture of
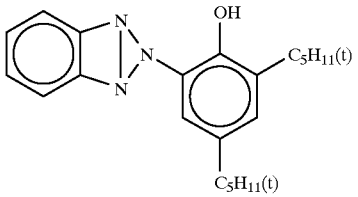
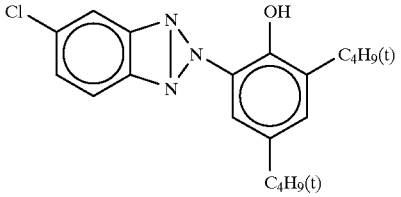
and
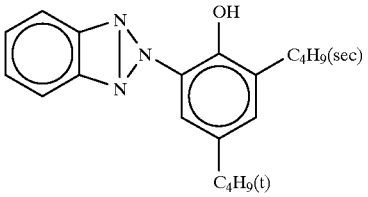
(Solv-1) Solvent
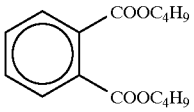
(Solv-2) Solvent
2:1 (by volume) mixture of
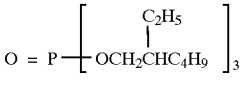
and
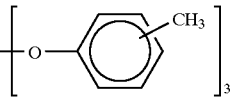
(Solv-4) Solvent
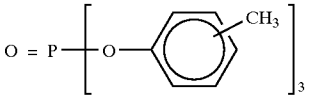

-continued (Solv-5) Sovent $COOC_8H_{17}$
|
$(CH_2)_8$
|
$COOC_8H_{17}$ (Solv-6) Sovent

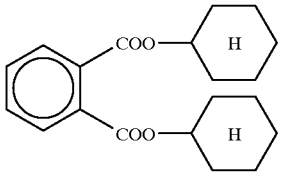

In a manner similar to described above, Samples 1 to 19 were prepared. As for each of the emulsions for the blue-sensitive layer in Samples 1 to 19, emulsions having or not having a silver bromide-rich phase, but having the same grain size, were prepared in the presence or absence of an iridium compound, and subjected to sulfur sensitization under their respective optimal conditions. Table 1 below lists, for each sample, whether the silver bromide-rich phase was present, and whether the iridium compound was present. As for the compound to be added which is represented by general formula (II) of this invention, the compounds listed in Table 1 were used in the course of the preparation of the above-described emulsions, respectively. Further, the yellow couplers listed in Table 1 were incorporated into the thus prepared emulsions, respectively.

Each of the thus obtained samples was exposed to light under such a condition that the silver to be developed amounted to 30% of the coated silver. The exposed samples were subjected to continuous photographic processing (running test), which constituted the processing steps described below, using a paper processor. The processing was continued until the amount of the replenisher used for the color development reached twice the volume of the color developing tank used. The thus obtained running solutions and those used at the start of the running processing were both employed in carrying out the sensitometry of each sample.

Each sample was subjected to wedgewise exposure for sensitometry through each filter for color separation with a sensitometer (Model FWH, produced by Fuji Photo Film Co. Ltd., equipped with a light source having a color temperature of 3,200° K.). Therein, the exposure time was set to 0.1 sec., and the exposure was controlled to 200 CMS. In addition to the processing for sensitometry in which the standard development time of 45 seconds was used, another processing was performed in which the development time was increased to 90 seconds by reducing the travelling speed of the film to one-half its standard speed in order to examine the minimum density (Dmin).

| Processing Step | Temperature | Time | Amount* replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |

-continued

| Processing Step | Temperature | Time | Amount* replenished | Tank Volume |
|---|---|---|---|---|
| Rinsing (3) | 30–35° C. | 20 sec. | 350 ml | 10 l |
| Drying | 70–80° C. | 60 sec. | | |

*per $m^2$ of light-sensitive material
(The rinsing processing was carried out using a 3-stage counter current process in which the rinsing water flowed from tank 3 to tank 1)

The composition of each processing solution used is described below.

Color Developer:

| | Tank Solution | Replenisher |
|---|---|---|
| Water | 800 ml | 800 ml |
| Ethylenediamine-N,N,N,N-tetra-methylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamido-ethyl)-3-methyl-4-aminoaniline-sulfate | 5.0 g | 7.0 g |
| N,N-bis(carboxymethyl)hydrazine | 5.5 g | 7.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |

Bleach-Fix Bath (Tank solution=Replenisher):

| | |
|---|---|
| Water | 400 ml |
| Ammonium thiosulfate (70%) | 100 ml |
| Sodium sulfite | 17 g |
| Ammonium ethylenediaminetetra-acetato ferrate(III) | 55 g |
| Disodium ethylenediamine-tetraacetate | 5 g |
| Ammonium bromide | 40 g |
| Water to make | 1,000 ml |
| pH (25° C.) adjusted to | 6.0 |

Rinsing Bath (Tank solution=Replenisher):

Ion exchange water (in which the calcium and magnesium ion concentrations were each below 3 ppm).

After each of the photographic processings, the densities of the developed colors in each sample were measured, and the sensitivity and gradient were determined for each sample.

The sensitivity was defined as the reciprocal of the exposure required to attain a developed color density of 1.5 plus the fog density. In Table 2, the sensitivities are shown as relative values, with the case in which a fresh color developer was used being taken as 100 with respect to each sample. The gradient was defined as the difference between the logarithm of the reciprocal of the exposure required to obtain a developed color density of 0.5 and that required to obtain a developed color density of 2.0. In order to evaluate the color reproducibility of the yellow image obtained in the area exposed to blue light, the reflection spectrum of the area in which the density of the yellow image was 1.0 was measured with a Hitachi Model 320 spectrophotometer, and the wavelength in the spectrum at which the reflection density reached 40% of the reflection density maximum (λ40) was determined. The results of this measurement indicate that clearer yellows can be reproduced at shorter wavelengths (λ40). The thus obtained data are summarized in Table 2.

Table 2 shows that the emulsions of this invention had high sensitivities and high contrast. Table 2 further shows that in a rapid processing system the emulsions incorporating the yellow couplers of this invention exhibited high sensitivity and high contrast without impairing the excellent features of the yellow couplers and the emulsions of the present invention.

Moreover, the effect of the combined use of the present emulsions and the present yellow couplers was not confined to the above-described effect. Decreases in sensitivity and contrast, which have resulted from the use of the present yellow couplers in cases where the color developer has been exhausted by running processing, were effectively prevented from occurring. In addition, Dmin in cases where an increased development time was used was decreased by the combined use of the emulsions and couplers of this invention. These results completely surpassed expectations.

TABLE 1

| Sample No. | Yellow Coupler | Emulsion: AgBr-localized Phase | Emulsion: Compound (II) | Emulsion: Ir Compound** | Note |
|---|---|---|---|---|---|
| 1 | ExY | present | II-2-6 | added | Comparison |
| 2 | ExY | present | II-2-6 | not added | Comparison |
| 3 | ExY | present | *EX-II | not added | Comparison |
| 4 | ExY | absent | II-2-6 | not added | Comparison |
| 5 | Y-1 | present | II-2-6 | added | Invention |
| 6 | Y-1 | present | II-2-6 | not added | Invention |
| 7 | Y-1 | present | *Ex-II | not added | Comparison |
| 8 | Y-1 | absent | II-2-6 | not added | Comparison |
| 9 | Y-1 | absent | *Ex-II | not added | Comparison |
| 10 | Y-5 | present | II-2-6 | added | Invention |
| 11 | Y-5 | present | II-2-6 | not added | Invention |
| 12 | Y-5 | present | *Ex-II | not added | Comparison |
| 13 | Y-5 | absent | II-2-6 | not added | Comparison |
| 14 | ExY | present | II-2-2 | not added | Comparison |
| 15 | ExY | present | II-2-5 | not added | Comparison |
| 16 | Y-1 | present | II-2-2 | not added | Invention |
| 17 | Y-1 | present | II-2-5 | not added | Invention |
| 18 | Y-5 | present | II-2-2 | not added | Invention |
| 19 | Y-5 | present | II-2-5 | not added | Invention |

*Ex-II: 4-Hydroxy-6-methyl-1,3,3a,7-tetrazaindene (Comparative compound, added in the equimolar amount)
**Ir compound: Hexachloroiridium ion, added in the amount of $3 \times 10^{-8}$ mole per mole of silver halide.

The couplers and the emulsions were used in amount equimolar with the amounts of the coupler and the emulsion used in Sample 1, respectively.

TABLE 2

| Sample No. | Sensitivity | Dmin | Change in Gradient | λ40 |
|---|---|---|---|---|
| 1 | 97 | 0.09 | 0.02 | 510 |
| 2 | 96 | 0.09 | 0.05 | 510 |
| 3 | 97 | 0.21 | 0.04 | 510 |
| 4 | 88 | 0.10 | 0.05 | 510 |
| 5 | 98 | 0.08 | 0.04 | 501 |
| 6 | 96 | 0.08 | 0.05 | 501 |
| 7 | 96 | 0.14 | 0.06 | 501 |
| 8 | 75 | 0.08 | 0.16 | 501 |
| 9 | 70 | 0.16 | 0.18 | 501 |
| 10 | 97 | 0.08 | 0.04 | 503 |
| 11 | 97 | 0.08 | 0.05 | 503 |
| 12 | 96 | 0.13 | 0.06 | 503 |
| 13 | 78 | 0.08 | 0.17 | 503 |
| 14 | 98 | 0.09 | 0.05 | 510 |
| 15 | 98 | 0.09 | 0.06 | 510 |
| 16 | 97 | 0.08 | 0.05 | 501 |
| 17 | 96 | 0.08 | 0.06 | 501 |
| 18 | 97 | 0.08 | 0.06 | 503 |
| 19 | 97 | 0.08 | 0:07 | 503 |

EXAMPLE 2

In a manner similar to Example 1, photographic processing with a paper processor was continued using the processing baths described below in accordance with the following processing steps until the amount of the replenisher used for the color development reached twice the volume of the color developing tank used (running test), and then the same photographic processing and examinations as in Example 1 were carried out. The thus obtained results were similar to those in Example 1.

| Processing Step | Temperature | Time | Amount* replenished | Tank Volume |
|---|---|---|---|---|
| Color development | 35° C. | 45 sec. | 161 ml | 17 l |
| Bleach-fix | 30–36° C. | 45 sec. | 215 ml | 17 l |
| Stabilization (1) | 30–37° C. | 20 sec. | — | 10 l |
| Stabilization (2) | 30–37° C. | 20 sec. | — | 10 l |
| Stabilization (3) | 30–37° C. | 20 sec. | — | 10 l |
| Stabilization (4) | 30–37° C. | 30 sec. | 248 ml | 10 l |
| Drying | 70–85° C. | 60 sec. | | |

*per $m^2$ of light-sensitive material
(The stabilization was carried out using a 4-stage counter current process flowing from te tank 4 to tank 1)

The composition of each processing solution used is described below.

Color Developer:

| | Tank Solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-amino anilinesulfate | 5.0 g | 7.0 g |
| Diethylhydroxylamine | 4.2 g | 6.0 g |

-continued

| | Tank Solution | Replenisher |
|---|---|---|
| Brightening agent (4,4'-diamino-stilbene type) | 2.0 g | 2.5 g |
| Water to make | 1,000 ml | 1,000 ml |
| pH (25° C.) adjusted to | 10.05 | 10.45 |

Bleach-Fix Bath (Tank solution=Replenisher):

| | |
|---|---|
| Water | 400 ml |
| Ammonium thiosulfate (70%) | 100 ml |
| Sodium sulfite | 17 g |
| Ammonium ethylenediaminetetra-acetato ferrate(III) | 55 g |
| Disodium ethylenediaminetetraacetate | 5 g |
| Glacial acetic acid | 9 g |
| Water to make | 1,000 ml |
| pH (25° C.) adjusted to | 5.40 |

Stabilizing Bath (Tank solution=Replenisher):

| | |
|---|---|
| Formaldehyde (37%) | 0.1 g |
| Formaldehyde-sulfite adduct | 0.7 g |
| 5-Chloro-2-methyl-4-isothiazoline-3-one | 0.02 g |
| 2-methyl-4-isothiazoline-3-one | 0.01 g |
| Copper sulfate | 0.005 g |
| Water to make | 1,000 ml |
| pH (25° C.) adjusted to | 4.0 |

In accordance with this invention, photosensitive materials for color print use are provided which have high sensitivity and excellent color reproducibility, and which contrast is effectively prevented from decreasing even where a color developer exhausted by running processing is used.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one silver halide emulsion layer on a reflex support, wherein at least one of the silver halide emulsion layers comprises (i) silver halide grains containing at least 90 mol % silver chloride and having a silver bromide-rich region in the vicinity of at least one grain corner, but having an average silver bromide content of 15 mol % or less at the grain surface, wherein at least the silver bromide-rich region of the silver halide grains contains an iridium compound, (ii) at least one coupler represented by the following general formula (I):

(I)

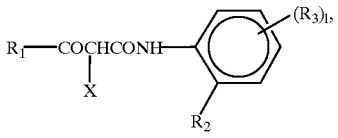

and (iii) at least one compound represented by the following general formula (II):

(II)

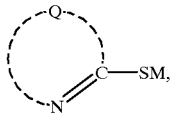

wherein $R_1$ represents an aryl group or a tertiary alkyl group; $R_2$ represents a fluorine atom, an alkyl group, an aryl group, an alkoxy group, an aryloxy group, a dialkylamino group, an alkylthio group, or an arylthio group; $R_3$ represents a group which can replace a hydrogen atom of a benzene ring; X represents a hydrogen atom or a group capable of being removed by a coupling reaction with an oxidation product of an aromatic primary amine developing agent; l represents an integer from 0 to 4, and when l is 2 or more, the $R_3$ groups may be the same or different;

Q represents a group of atoms necessary to complete a 5- or 6-membered hetero ring which may be fused together with a benzene ring; and M represents a hydrogen atom or cation.

2. The silver halide color photographic material of claim 1, wherein the compound represented by the general formula (II) is selected from the group of compounds represented by the following general formulae (II-1), (II-2), (II-3) and (II-4):

(II-1)

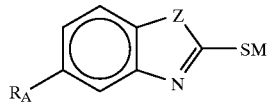

wherein, $R_A$ represents a hydrogen atom, an alkyl group, an alkoxy group, an aryl group, a halogen atom, a carboxyl group or its salt, a sulfo group or its salt, or an amino group; Z represents —NH—, —O—, or —S—; and M has the same meaning as in general formula (II);

(II-2)

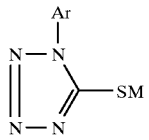

wherein, Ar represents

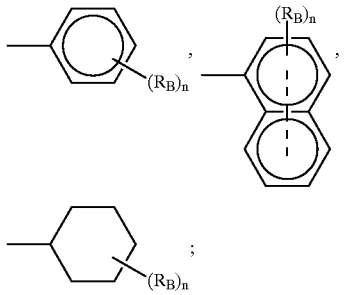

$R_B$ represents an alkyl group, an alkoxy group, a carboxyl group or its salt, a sulfo-group or its salt, a hydroxyl group, an amino group, an acylamino group, a carbamoyl group, or a sulfonamido group;

n represents an integer from 0 to 2; and M has the same meaning as in general formula (II);

(II-3)

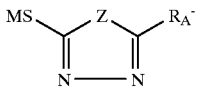

wherein, Z represents

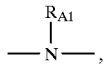

an oxygen atom, or a sulfur atom; $R_A$ represents a hydrogen atom, an alkyl group, an aryl group, an alkenyl group, a cycloalkyl group, —$SR_{A1}$, —$NR_{A2}R_{A3}$, —$NHCOR_{A4}$, —$NHSO_2R_{A5}$, or a heterocyclic group; $R_{A1}$ represents a hydrogen atom, an alkyl group, an alkenyl group, a cycloalkyl group, an aryl group, —$COR_{A4}$ or —$SO_2R_{A5}$; $R_{A2}$ and $R_{A3}$ each represents a hydrogen atom, an alkyl group, or an aryl group; $R_{A4}$ and $R_{A5}$ each represents an alkyl group, or an aryl group; and M has the same meaning as in general formula (II);

(II-4)

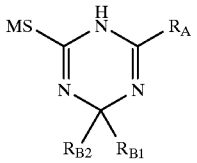

wherein, $R_A$ and M have the same meanings as in general formula (II-3), respectively, and $R_{B1}$ and $R_{B2}$ have the same meanings as $R_{A1}$ and $R_{A2}$ in general formula (II-3), respectively.

3. The silver halide color photographic material of claim 1, wherein $R_1$ in the general formula (I) represents a 2 or 4-alkoxyaryl group or a t-butyl group.

4. The silver halide color photographic material of claim 1, wherein $R_2$ in the general formula (I) represents a methyl group, an ethyl group, an alkoxy group, an aryloxy group or a dialkylamino group.

5. The silver halide color photographic material of claim 1, wherein $R_3$ in the general formula (I) represents an alkoxy group, a carbonamido group or a sulfonamido group.

6. The silver halide color photographic material of claim 1, wherein X in the general formula (I) represents a heterocyclic group attached to the active coupling site via a nitrogen atom, or an aryloxy group.

7. The silver halide color photographic material of claim 6, wherein the heterocyclic group represented by X is the group represented by the following formula (III);

(III)

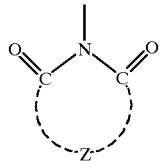

wherein, Z represents

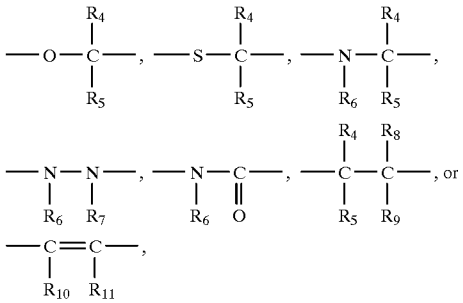

wherein, $R_4$, $R_5$, $R_8$ and $R_9$ each represents a hydrogen atom, an alkyl group, an aryl group, an alkoxy group, an aryloxy group, an alkylthio group, an arylthio group, an alkylsulfonyl group, an arylsulfonyl group, or an amino group, $R_6$ and $R_7$ each represents a hydrogen atom, an alkyl group, an aryl group, an alkylsulfonyl group, an arylsulfonyl group, or an alkoxycarbonyl group, $R_{10}$ and $R_{11}$ each represents a hydrogen atom, an alkyl group, or an aryl group, $R_{10}$ and $R_{11}$ may combine with each other to form a benzene ring, and $R_4$ and $R_5$, $R_5$ and $R_6$, $R_6$ and $R_7$, or $R_4$ and $R_8$ may combine with each other to form a ring.

8. The silver halide color photographic material of claim 1, wherein the amount of the coupler represented by general formula (I) is from $1\times10^{-4}$ to $5\times10^{-3}$ mole per square meter of photographic material.

9. The silver halide color photographic material of claim 1, wherein the amount of the coupler reprsented by general formula (I) is from $2\times10^{-4}$ to $1\times10^{-3}$ mole per square meter of photographic material.

10. The silver halide color photographic material of claim 1, wherein the amount of the compound reprsented by general formula (II) is from $1\times10^{-5}$ to $5\times10^{-2}$ mole per mole of silver halide.

11. The silver halide color photographic material of claim 1, wherein the amount of the compound represented by general formula (II) is from $1\times10^{-4}$ to $1\times10^{-2}$ mole per mole of silver halide.

12. The silver halide color photographic material of claim 1, wherein the photographic material contains at least one compound selected from the group of compounds represented by the following general formulas (Is), (IIs), and (IIIs):

(Is)

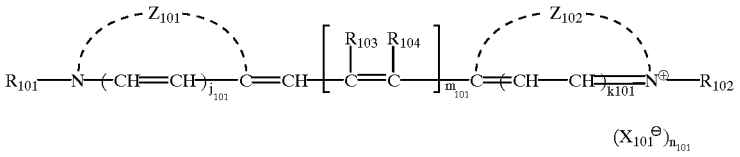

wherein $Z_{101}$ and $Z_{102}$ each represents a group of atoms necessary to complete a heterocyclic nucleus:

$R_{101}$ and $R_{102}$ each represents an alkyl group, an alkenyl group, an alkynyl group, or an aralkyl group;

$m_{101}$ represents 0 or a positive integer from 1 to 3;

when $m_{101}$ represents 1, $R_{103}$ represents a hydrogen-atom, a lower alkyl group, an aralkyl group, or an aryl group, and $R_{104}$ represents a hydrogen atom;

when $m_{101}$ represents 2 or 3, $R_{103}$ represents a hydrogen atom, and $R_{104}$ represents a hydrogen atom, a lower alkyl group or an aralkyl group and further can combine with $R_{102}$ to form a 5- or 6-membered ring, and $R_{103}$ may combine with another $R_{103}$ to form a hydrocarbon or a heterocyclic ring when $m_{101}$ represents 2 or 3 and $R_{104}$ represents a hydrogen atom; and $j_{101}$ and $k_{101}$ each represents 0 or 1, $X_{101}^-$ represents an acid anion, and $n_{101}$ represents 0 or 1;

(IIIs)

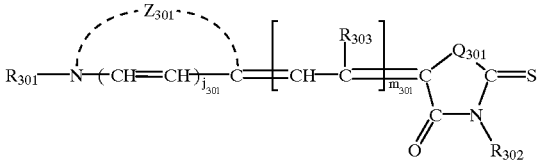

wherein $Z_{301}$ represents a group of atoms necessary to complete a heterocyclic ring;

$Q_{301}$ has the same meaning as $Q_{201}$;

$R_{301}$ has the same meaning as $R_{101}$ or $R_{102}$;

$R_{302}$ has the same meaning as $R_{203}$;

$m_{301}$ has the same meaning as $m_{201}$;

(IIs)

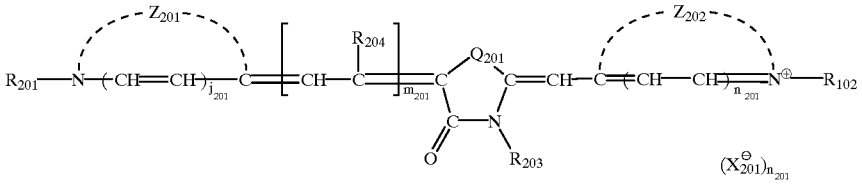

wherein $Z_{201}$ and $Z_{202}$ have the same meanings as $Z_{101}$ and $Z_{102}$, respectively;

$R_{201}$ and $R_{202}$ have the same meanings as $R_{101}$ and $R_{102}$, respectively;

$R_{203}$ represents an alkyl group, an alkenyl group, an alkynyl group, or an aryl group;

$m_{201}$ represents 0, 1 or 2;

$R_{204}$ represents a hydrogen atom, a lower alkyl group or an aryl group, and one $R_{204}$ group may combine with the other $R_{204}$ group to form a hydrocarbon or hetero ring when $m_{201}$ represents 2;

$Q_{201}$ represents a sulfur atom, an oxygen atom, a selenium atom, or $=N—R_{205}$;

$R_{205}$ has the same meaning as $R_{203}$; and $j_{201}$, $k_{201}$, $X_{201}^-$ and $n_{201}$ have the same meanings as $j_{101}$, $k_{101}$, $X_{101}^-$ and $n_{101}$, respectively;

$R_{303}$ has the same meaning as $R_{204}$, and $R_{303}$ further may combine with another $R_{303}$ to form a hydrocarbon or heterocyclic ring when $m_{301}$ represents 2 or 3; and $j_{301}$ has the same meaning as $j_{101}$.

13. The silver halide color photographic material of claim 1, wherein the amount of the iridium compound is from $1\times10^{-8}$ to $1\times10^{-5}$ mole per mole of silver.

14. The silver halide color photographic material of claim 1, wherein the silver halide emulsion is a silver chlorobromide emulsion containing 95 mol % or more of silver chloride.

15. The silver halide color photographic material of claim 14, wherein the silver halide emulsion is a silver chlorobromide emulsion containing 99 mol % or more of silver chloride.

* * * * *